US006947686B2

(12) United States Patent
Kawai et al.

(10) Patent No.: US 6,947,686 B2
(45) Date of Patent: Sep. 20, 2005

(54) PROCESS CARTRIDGE AND SPACER FOR SAME

(75) Inventors: Tachio Kawai, Odawara (JP); Takeshi Arimitsu, Odawara (JP); Hideki Maeshima, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 34 days.

(21) Appl. No.: 10/368,375

(22) Filed: Feb. 20, 2003

(65) Prior Publication Data

US 2003/0185587 A1 Oct. 2, 2003

(30) Foreign Application Priority Data

Feb. 22, 2002 (JP) ..... 2002-045633

(51) Int. Cl.[7] ..... G03G 21/18
(52) U.S. Cl. ..... 399/111; 399/113
(58) Field of Search ..... 399/110, 111, 399/113, 116, 119

(56) References Cited

U.S. PATENT DOCUMENTS

| | | | | |
|---|---|---|---|---|
| 5,903,803 | A | 5/1999 | Kawai et al. | 399/116 |
| 5,946,531 | A | 8/1999 | Miura et al. | 399/111 |
| 6,002,896 | A | 12/1999 | Miyamoto et al. | 399/114 |
| 6,055,406 | A | 4/2000 | Kawai et al. | 399/360 |
| 6,061,538 | A | 5/2000 | Arimitsu et al. | 399/111 |
| 6,115,567 | A | 9/2000 | Kawai et al. | 399/106 |
| 6,128,454 | A | 10/2000 | Kawai et al. | 399/116 |
| 6,163,665 | A | 12/2000 | Watanabe et al. | 399/111 |
| 6,175,706 | B1 | 1/2001 | Watanabe et al. | 399/111 |
| 6,226,478 | B1 | 5/2001 | Watanabe et al. | 399/117 |
| 6,240,266 | B1 | 5/2001 | Watanabe et al. | 399/117 |
| 6,282,390 | B1 | 8/2001 | Miyabe et al. | 399/111 |
| 6,336,018 | B1 | 1/2002 | Kawai et al. | 399/117 |
| 6,351,620 | B1 | 2/2002 | Miyabe et al. | 399/111 |
| 6,381,430 | B1 | 4/2002 | Yokomori et al. | 399/119 |
| 6,459,869 | B2 | 10/2002 | Nittani et al. | 399/111 |
| 6,463,232 | B1 | 10/2002 | Kawai et al. | 399/111 |
| 6,463,234 | B2 | 10/2002 | Arimitsu et al. | 399/113 |
| 6,480,687 | B1 | 11/2002 | Kawai et al. | 399/111 |
| 6,493,527 | B1 | 12/2002 | Higeta et al. | 399/111 |
| 6,496,667 | B2 | 12/2002 | Shiratori et al. | 399/103 |
| 6,501,926 | B1 | 12/2002 | Watanabe et al. | 399/117 |
| 6,501,927 | B1 | 12/2002 | Watanabe et al. | 399/117 |
| 6,665,507 | B1 * | 12/2003 | Hooper et al. | 399/110 |
| 6,681,088 | B2 * | 1/2004 | Kanno et al. | 399/111 |
| 6,681,089 | B2 * | 1/2004 | Dougherty | 399/111 |
| 2002/0018668 | A1 | 2/2002 | Kanno et al. | 399/106 |
| 2002/0031368 | A1 | 3/2002 | Kanno et al. | 399/103 |
| 2002/0110388 | A1 | 8/2002 | Yokomori et al. | 399/167 |

FOREIGN PATENT DOCUMENTS

| | | |
|---|---|---|
| JP | 5-232752 | 9/1993 |
| JP | 2001-125471 | 5/2001 |
| JP | 2001-282079 | 10/2001 |

* cited by examiner

*Primary Examiner*—William J. Royer
(74) *Attorney, Agent, or Firm*—Fitzpatrick, Cella, Harper & Scinto

(57) ABSTRACT

A process cartridge detachably mountable to a main assembly of an image forming apparatus includes an electrophotographic photosensitive drum; a developing roller for developing an electrostatic latent image formed on the drum; a first frame supporting the drum; a second frame supporting the developing roller; a coupling member for coupling the first frame and the second frame such that developing roller and the drum contact each other or are spaced from each other; an urging member for urging the drum and the developing roller toward each other; a spacer member for maintaining the drum and the developing roller spaced from each other or the distance between centers of the drum and the developing roller to be larger than the distance therebetween during an image forming operation. The spacer member supports the first frame and second frame at least at longitudinally extending surfaces of the process cartridge, and is detachable from the process cartridge.

20 Claims, 14 Drawing Sheets

(a)

(b)

PROCESS CARTRIDGE AND SPACER FOR SAME

FIELD OF THE INVENTION AND RELATED ART

The present invention relates to a process cartridge for an electrostatic image forming apparatus, for example, a printer, a copying machine, and the like. It also relates to a member for maintaining a predetermined gap between an electrophotographic photoconductive drum and a development roller, in a process cartridge. Further, it relates to an image forming apparatus.

Hereafter, a process cartridge is a cartridge in which an electrophotographic photoconductive member, and at least a development roller functioning as a developing means, are integrally disposed, and which is removably mountable in a main assembly of an image forming apparatus. It also refers to a cartridge in which an electrophotographic photoconductive member, a developing means, and at least one of a charging means and a cleaning means, are integrally disposed, and which is removably mountable in a main assembly of an image forming apparatus.

An electrophotographic image forming apparatus is an apparatus which forms an image on a recording medium, for example, a recording paper, an OHP sheet, fabric, and the like, with the use of an electrophotographic image formation process. It includes, for example, an electrophotographic copying machine, an electrophotographic printer (an LED printer, a laser beam printer, and the like), an electrophotographic facsimile machine, an electrophotographic wordprocessor, and the like.

A process-cartridge system is a cartridge system in which an electrophotographic photoconductive drum (which hereinafter may be referred to a photoconductive drum), and one or more processing means, which act on the photoconductive drum, are integrally disposed in a cartridge removably mountable in a main assembly of an image forming apparatus. With the employment of a process-cartridge system, a user can maintain an image forming apparatus him/herself without relying on service personnel, drastically improving operational efficiency. Thus, a process-cartridge system has been widely used in the field of an image forming apparatus.

An image forming apparatus employing a process cartridge forms an image with the use of developer, which is stored in a developer-storage portion, and which is supplied to a photoconductive drum with the use of a development roller. In the case of a so-called contact-developing method, a development roller is placed in contact with a photoconductive drum for development. Generally, a development roller used for the contact-developing method comprises an electrically conductive substructual member, and one or more electrically resistive layers layered on the substructual member. The electrically resistive layers are greater in electrical resistance than the substructural member, and the topmost electrically resistive layers are placed in contact with the photoconductive drum. In order to prevent a development roller from damaging the photoconductive drum, an elastic substance, such as rubber, in which electrically conductive particles are dispersed, is used as the material for the development roller. Further, in order to stabilize the state of contact between the development roller and the photoconductive drum, that is, in order to stabilize the contact area (nip) between the peripheral surfaces of the development roller and the photoconductive drum, that is, the area in which development can occur, the development roller is kept pressed on the photoconductive drum with a pressure-applying member, such as a spring.

As described above, a process cartridge in accordance with the prior art contains a pressure-applying means, such as a spring, for keeping the development roller pressed on the photoconductive drum. Therefore, during the shipment of a process cartridge, that is, between the completion of the manufacture of a process cartridge and the mounting of the process cartridge into the main assembly of an image forming apparatus, there is the possibility that the development roller will deform in a manner to conform to the contour of the peripheral surface of the photoconductive drum, with which the development roller is in contact.

When an image is formed with the use of a development roller having been deformed as described above, there is the possibility that as the deformed portion of the development roller is brought by the rotation of the development roller to the contact area between the development roller and photoconductive drum, the state of the contact area between the development roller and photoconductive drum will change, resulting in unsatisfactory development.

Thus, the present invention was made to further develop the above-described prior art.

SUMMARY OF THE INVENTION

The primary object of the present invention is to provide: a process cartridge in which a gap can be maintained between an electrophotographic photoconductive drum and a development roller; an electrophotographic image forming apparatus in which such a process cartridge can be removably mountable; and a gap-maintaining member.

Another object of the present invention is to provide: a process cartridge in which an electrophotographic photoconductive drum can be kept apart from a development roller during the shipment of the process cartridge; an electrophotographic image forming apparatus in which such a process cartridge is removably mountable; and a gap-maintaining member.

Another object of the present invention is to provide: a process cartridge in which damage to the peripheral surface of an electrophotographic photoconductive drum and/or a development roller is prevented by keeping the electrophotographic photoconductive drum apart from the development roller, an electrophotographic image forming apparatus in which such a process cartridge is removably mountable; and a gap-maintaining member.

Another object of the present invention is to provide a process cartridge in which the deformation of the peripheral surface of an electrophotographic photoconductive drum and/or a development roller is prevented by keeping the electrophotographic photoconductive drum apart from the development roller; an electrophotographic image forming apparatus in which such a process cartridge is removably mountable; and a gap-maintaining member.

Another object of the present invention is to provide: a process cartridge in which there is no possibility that contact between a development roller and a photoconductive drum will make the development roller conform in shape to the peripheral surface of the photoconductive drum, during the shipment of the process cartridge; and a gap-maintaining member for such a process cartridge.

Another object of the present invention is to provide: a gap-maintaining member for keeping a developing-means holding frame and a cleaning-means holding frame of a process cartridge, clamped together, at least at one of the lengthwise ends of a process cartridge, in order to keep an electrophotographic photoconductive drum and a development roller separated from each other, or to keep the distance between the axial lines of the electrophotographic photoconductive drum and the development roller at an increased value compared to the distance during image formation; a process cartridge employing such a gap-maintaining member; and an image forming apparatus compatible with such a gap-maintaining member and a process cartridge.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described with reference to the appended drawings.

Figure 1:
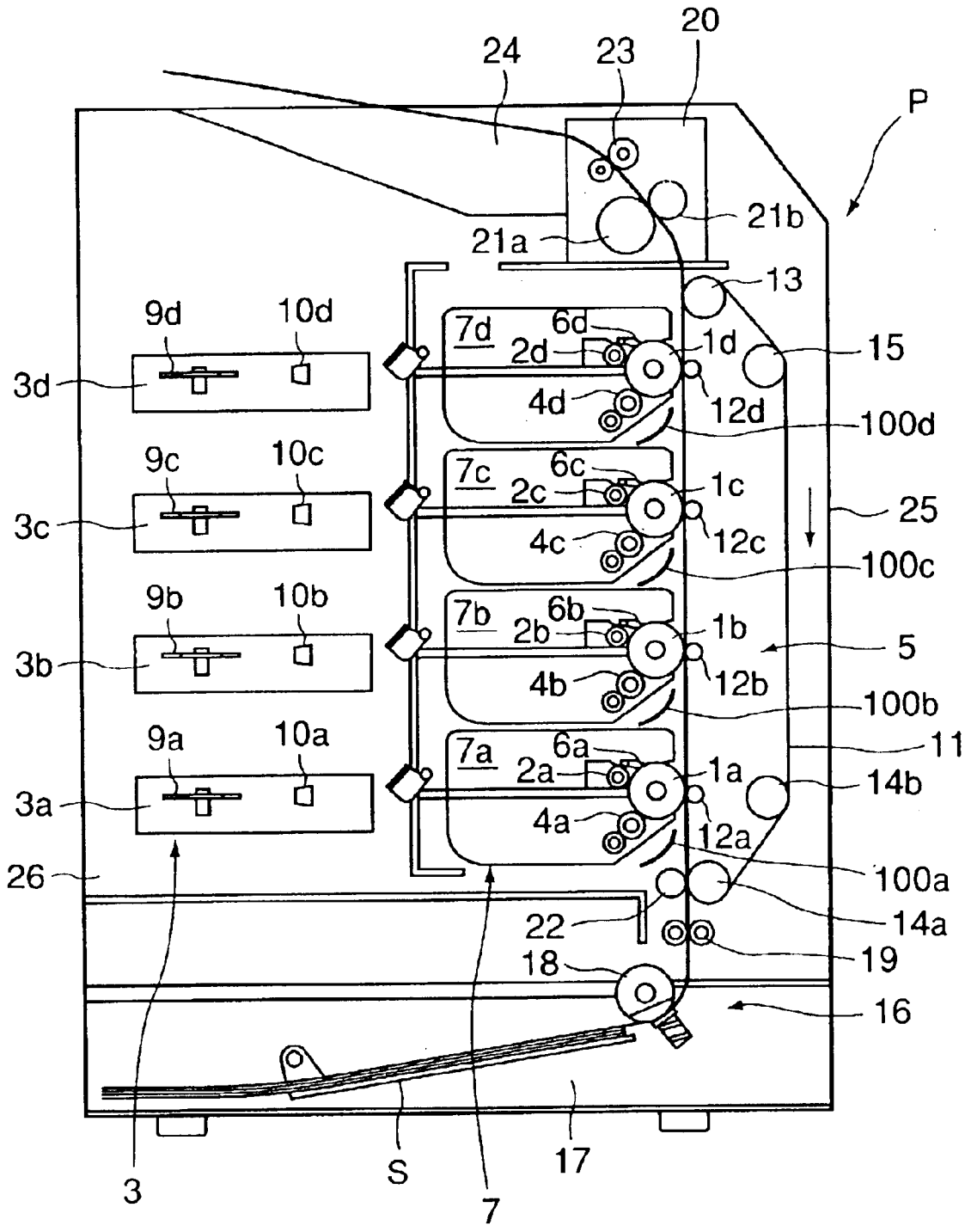
FIG. 1 is a schematic vertical sectional view of a full-color laser-beam image forming apparatus, as an embodiment of an image forming apparatus in accordance with the present invention, for showing the general structure thereof.

First, referring to FIG. 1, the general structure of a typical multicolor image forming apparatus in accordance with the present invention, and the image forming operation thereof, will be described. FIG. 1 is a vertical sectional view of a full-color image forming apparatus as an embodiment of an image forming apparatus in accordance with the present invention, for showing the general structure thereof.

The image-forming apparatus in FIG. 1 has a plurality (four in FIG. 1) of image-formation stations, which are vertically stacked, and each of which has a photoconductive drum 1 functioning as an image bearing member. The photoconductive drum 1 (1*a*, 1*b*, 1*c*, 1*d*) in each image-formation station is rotationally driven by an unshown driving means in the counterclockwise direction in FIG. 1. Disposed around the photoconductive drum 1 (1*a*, 1*b*, 1*c*, 1*d*) in each image-formation station, listed in the order of the rotational direction of the photoconductive drum 1 (1*a*, 1*b*, 1*c*, 1*d*), are a charging apparatus 2 (2*a*, 2*b*, 2*c*, 2*d*) for uniformly charging the peripheral surface of the photoconductive drum 1 (1*a*, 1*b*, 1*c*, 1*d*), a scanner unit 3 (3*a*, 3*b*, 3*c*, 3*d*) for forming an electrostatic latent image on the peripheral surface of the photoconductive drum 1 by projecting a beam of laser light onto the peripheral surface of the photoconductive drum 1 while modulating the beam of laser light with image-formation information, a developing apparatus (4*a*, 4*b*, 4*c*, 4*d*) for developing the electrostatic latent image into an image formed of developer (which hereinafter will be referred to as a developer image) by adhering developer to the electrostatic latent image, an electrostatic transfer belt 11 and a transfer roller (12*a*, 12*b*, 12*c*, 12*d*) of an electrostatic transferring apparatus 5 for transferring the developer image on the photoconductive drum 1 onto a recording medium S, and a cleaning apparatus 6 (6*a*, 6*b*, 6*c*, 6*d*) for removing a transfer residual developer, or the developer remaining on the peripheral surface of the photoconductive drum 1 after image transfer.

Figure 2:
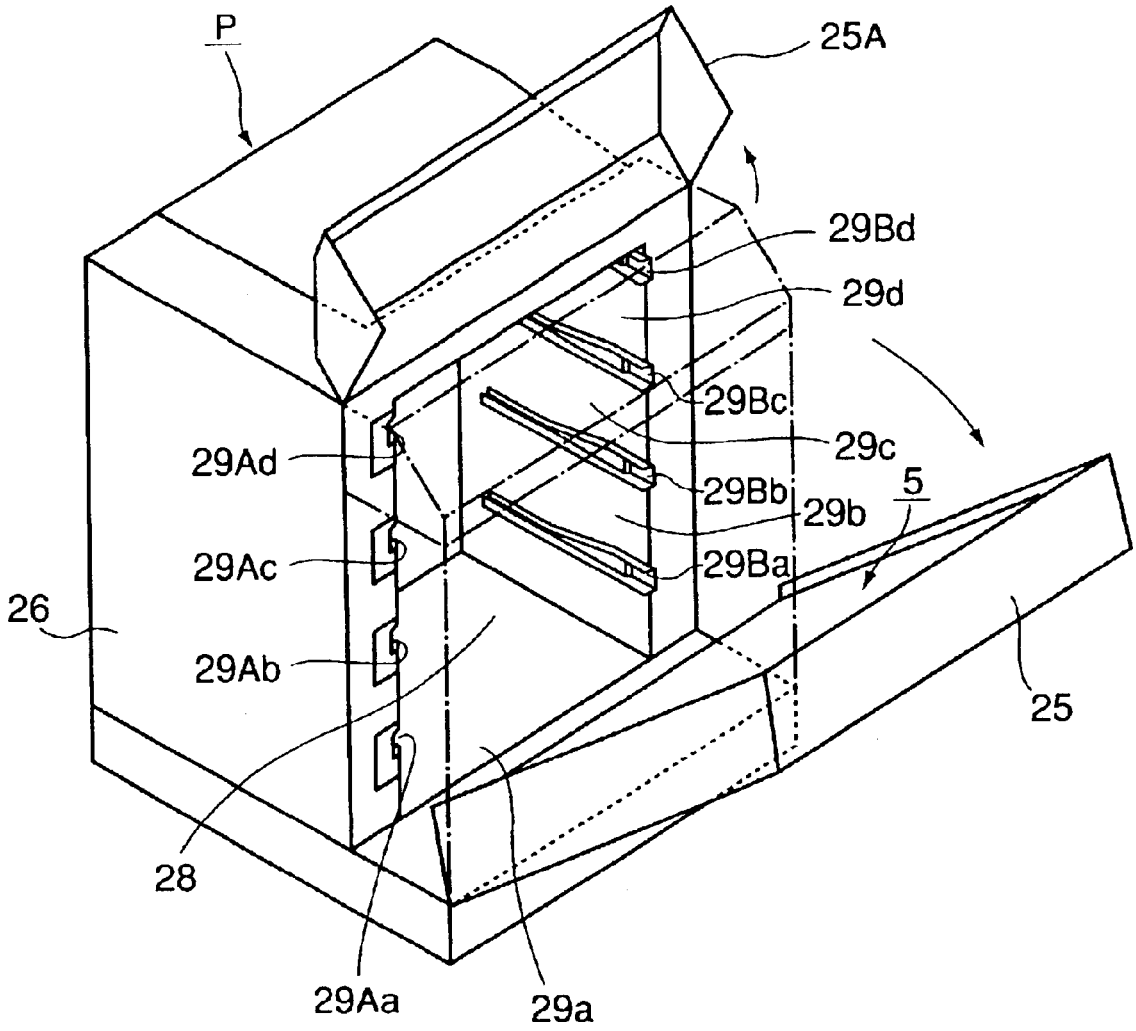
FIG. 2 is a perspective view of an embodiment of an image forming apparatus in accordance with the present invention, the front cover of which is open.

In this embodiment, the photoconductive drums 1 (1*a*, 1*b*, 1*c*, 1*d*), charging apparatuses 2 (2*a*, 2*b*, 2*c*, 2*d*), developing apparatuses (4*a*, 4*b*, 4*c*, 4*d*), cleaning apparatuses 6 (6*a*, 6*b*, 6*c*, 6*d*), developer storage portions, and so forth, are integrally disposed in cartridges, making up four process cartridges 7 (7*a*, 7*b*, 7*c*, 7*d*), which are removably mounted in cartridge-mounting portions 29 (29*a*, 29*b*, 29*c*, 29*d*) of an image forming apparatus P (FIG. 2). The scanner units 3 (3*a*, 3*b*, 3*c*, 3*d*) are attached to the main assembly 26 of the image forming apparatus P.

Each photoconductive drum 1 (1*a*, 1*b*, 1*c*, 1*d*) comprises a substrate, for example, an aluminum cylinder with a diameter of 30 mm, and a layer of organic photoconductor applied on the peripheral surface of the substrate. The photoconductive drum 1 is rotatably supported by a pair of supporting members, by its lengthwise ends. To one of the lengthwise ends of the photoconductive drum 1, a driving force is transmitted from a motor on the image-forming-apparatus side, rotationally driving the photoconductive drum 1 in the counterclockwise direction in FIG. 1.

As the charging apparatus 2 (2*a*, 2*b*, 2*c*, 2*d*), a contact-type charging apparatus can be employed. The charging apparatus 2 has an electrically conductive roller, or a charge roller. As charge bias is applied to the charge roller while the charge roller is in contact with the peripheral surface of the photoconductive drum 1, the peripheral surface of the photoconductive drum 1 is uniformly charged.

The scanner unit 3 (3*a*, 3*b*, 3*c*, 3*d*) is disposed at approximately the same level as the corresponding photoconductive drum 1 (1*a*, 1*b*, 1*c*, 1*d*). The scanner unit 3 (3*a*, 3*b*, 3*c*, 3*d*) has a laser diode (unshown), a polygon mirror (9*a*, 9*b*, 9*c*, 9*d*) rotated at a high speed by a scanner motor (unshown), a focusing lens (10*a*, 10*b*, 10*c*, 10*d*), and so forth. The image-formation light is projected from the laser diode, while being modulated with image-formation signals, onto the polygon mirror, is deflected by the polygon mirror, and is focused on the peripheral surface of the photoconductive drum 1 by the focusing lens, selectively exposing the numerous points of the peripheral surface of the photoconductive drum 1. With the repetition of the above-described process, electrostatic latent images corresponding to various color components are formed.

The developing apparatuses (4*a*, 4*b*, 4*c*, 4*d*) have developer containers containing yellow, magenta, cyan, and black developers, one for one. Each developing apparatus 4 develops the electrostatic latent image on the corresponding photoconductive drum 1 (1*a*, 1*b*, 1*c*, 1*d*) into a developer image, by adhering the developer of the corresponding color to the drum.

The cleaning apparatus 6 (6*a*, 6*b*, 6*d*, 6*d*) is an apparatus for removing, by scraping, the developer remaining on the peripheral surface of the photoconductive drum 1 after the transfer of the developer image on the peripheral surface of the photoconductive drum 1 onto the recording medium S by the electrostatic transferring apparatus 5. The portion of the peripheral surface of the photoconductive drum 1, from which the transfer residual developer has been removed by the cleaning apparatus 6, that is, the cleaned portion of the peripheral surface of the photoconductive drum 1, is usable for the image-formation process during the following rotation of the photoconductive drum 1.

The electrostatic transferring apparatus 5 comprises the electrostatic transfer belt 11, which is disposed in a manner to sequentially place the recording medium S in contact with the peripheral surface of each of the photoconductive drums 1 (1*a*, 1*b*, 1*c*, 1*d*) and conveys the recording medium S while keeping it electrostatically adhered thereto. It also comprises a plurality of transfer rollers (12*a*, 12*b*, 12*c*, 12*d*) disposed in a manner to oppose the corresponding photoconductive drum 1, with the interposition of the electrostatic transfer belt 11, in order to transfer the developer image on the corresponding photoconductive drum 1 onto the recording medium S.

The electrostatic transfer belt 11 is formed of film with a specific volume resistance of $10^{11}$–$10^{14}$ Ω·cm, and is disposed so that it remains in contact with all of the photoconductive drums 1 (1*a*, 1*b*, 1*c*, 1*d*) while being rotated. The electrostatic transfer belt 11 in this embodiment is approximately 700 mm in circumference and approximately 150 μm in thickness. It is stretched around four rollers: a drive roller 13, follower rollers 14*a* and 14*b*, and a tension roller 15, and is driven to circulate by the drive roller 13 in the direction indicated by an arrow mark in FIG. 1. The electrostatic transferring apparatus 5 also has an electrostatic adhesion roller 22 disposed in a manner to oppose the bottommost follower roller 14*a*, with the interposition of the electrostatic transfer belt 11. As voltage is applied between the electrostatic transfer belt 11 and the electrostatic adhesion roller 22 while the electrostatic adhesion roller 22 is kept pressed upon the outward surface of the electrostatic transfer belt 11, with the recording medium S nipped between the electrostatic adhesion roller 22 and the electrostatic transfer belt 11, electrical charge is induced in the recording medium S, which is dielectric, and the dielectric layer of the electrostatic transfer belt 11, electrostatically adheres the recording medium S to the outward surface of the electrostatic transfer belt 11.

The transfer roller (12*a*, 12*b*, 12*c*, 12*d*) is disposed in a manner to oppose the corresponding photoconductive drum 1 (1*a*, 1*b*, 1*c*, 1*d*), being in contact with the inward surface of the electrostatic transfer belt 11. As positive electrical charge is given to the recording medium S from the transfer roller through the electrostatic transfer belt 11, the negatively-charged developer image on the photoconductive drum 1 is transferred onto the recording medium S, by the electric field generated by the electrical charge given to the recording medium S, while the recording medium S is in contact with the photoconductive drum 1.

In order to sequentially place the recording medium S in contact with each of the photoconductive drums 1 (1*a*, 1*b*, 1*c*, 1*d*) in the electrostatic transferring apparatus 5 structured as described above, the electrostatic transfer belt 11 is moved to circulate, with the recording medium S electrostatically adhered, by the electrostatic adhesion roller 22, to the outward surface of the portion of the electrostatic transfer belt 11, which is moving through the left side of its circulatory path in FIG. 1. While the recording medium S is conveyed from the point corresponding to the follower roller 14*a* to the point corresponding to the drive roller 13, the developer image on each of the photoconductive drums 1 (1*a*, 1*b*, 1*c*, 1*d*) is transferred onto the recording medium S by the function of the transfer roller (12*a*, 12*b*, 12*c*, 12*d*) opposing the corresponding photoconductive drum 1.

A sheet feeding portion 16 is a portion for feeding the recording medium S into the image-formation station. It comprises a feeding cassette 17 in which a plurality of recording media S are held. During an image-forming operation, a feed roller (semicylindrical roller) 18, and a pair of registration rollers 19, are rotationally driven in response to the image-forming operation, so that the recording media S in the feeding cassette 17 are fed one by one into the image-forming station. As the leading edge of the recording medium S comes into contact with the pair of registration rollers 19, the recording medium S is temporarily halted, being forced to slightly bow. Then, the rotational driving of the pair of registration rollers 19 is started in synchronism with the circulatory movement of the electrostatic transfer belt 11, and the movement of the image-formation starting line on the peripheral surface of the photoconductive drum 1, releasing the recording medium S onto the electrostatic transfer belt 11.

A fixing portion 20 is a portion for fixing the plurality of developer images, different in color, on the recording medium S. It comprises a fixing rollers 21*a* and 21*b*. Fixing roller 21*a* is a rotational heat roller, and fixing roller 21*b* is a rotational pressure roller kept pressed on the heat roller 21*a* to apply heat and pressure to the recording medium S. More specifically, after the transfer of the developer image on each of the photoconductive drums 1 onto the recording medium S, the recording medium S is conveyed through the fixing portion 20, by the pair of fixing rollers (21*a* and 21*b*). While the recording medium S is conveyed through the fixing portion 20, heat and pressure are applied to the recording medium S. As a result, the plurality of developer images, different in color, are fixed to the surface of the recording medium S.

Referring to FIG. 1, reference numeral 25 designates a front cover of the main assembly 26 of the image forming apparatus P, and reference numeral 100 (100*a*, 10*b*, 100*c*, 100*d*) designates a drum shutter for covering the opening formed in the external wall of the frame of the process cartridge 7 (7*a*, 7*b*, 7*c*, 7*d*) to partially expose the photoconductive drum 1 (1*a*, 1*b*, 1*c*, 1*d*). In FIG. 1, the drum shutter 100 is at the location to which it retreats from the location at which it covers the opening. The details of the front cover 25, the drum shutter 100, and so forth, will be described later.

Next, the image-forming process carried out by the image forming apparatus P in accordance with the present invention will be described.

The process cartridges 7 (7*a*, 7*b*, 7*c*, 7*d*) in the cartridge-mounting portion 29 of the image forming apparatus P are sequentially driven in synchronism with the printing timing. As they are driven, the photoconductive drums 1 (1*a*, 1*b*, 1*c*, 1*d*) are rotationally driven in the counterclockwise direction, and the scanner units 3 (3*a*, 3*b*, 3*c*, 3*d*) are sequentially driven in synchronism with the sequential driving of the corresponding process cartridges 7 (7*a*, 7*b*, 7*c*, 7*d*).

While each photoconductive drum 1 (1*a*, 1*b*, 1, 1*d*) is driven, its peripheral surface is uniformly charged by the corresponding charging apparatus 2 (2*a*, 2*b*, 2*c*, 2*d*), and is exposed to the beam of light projected onto the charged portion of the peripheral surface of the photoconductive drum 1 while being modulated with image-formation signals. As a result, electrostatic latent images corresponding, one for one, to relevant color components are formed on the peripheral surfaces of the photoconductive drums 1 (1*a*, 1*b*, 1*c*, 1*d*), one for one. A development roller in each of the developing apparatuses (4*a*, 4*b*, 4*c*, 4*d*) supplies a developer in the developer-storage portion to the peripheral surface, in the development station, in which the developer is transferred onto the low potential-level points of the electrostatic latent image. As a result, a developer image is formed (developed) on the peripheral surface of the photoconductive drum 1 (1*a*, 1*b*, 1*c*, 1*d*).

The rotation of the pair of registration rollers 19 is started to deliver the recording medium S to the electrostatic transfer belt 11 with such a timing that as the recording medium S is conveyed by the electrostatic transfer belt 11, the leading edge of the developer image on the peripheral surface of the photoconductive drum 1*a*, that is, the most upstream photoconductive drum 1 in terms of the circulatory movement of the electrostatic transfer belt 11, and the recording medium S, arrive at the same time at the location where the peripheral surface of the photoconductive drum 1*a* meets the electrostatic transfer belt 11.

The recording medium S is pressed onto the outward surface of the electrostatic transfer belt 11 by the electrostatic adhesion roller 22 the follower roller 14*a*, and remains electrostatically adhered to the outward surface of the electrostatic transfer belt 11 by the application of voltage between the electrostatic transfer belt 11 and the electrostatic adhesion roller 22. In other words, with the provision of the above-described arrangement, it is ensured that the recording medium S is conveyed to the most downstream transfer station while remaining properly adhered to the electrostatic transfer belt 11.

While the recording medium S is conveyed by the electrostatic transfer belt 11 as described above, the developer images different in color on the photoconductive drum 1*a*, 1*b*, 1*c*, 1*d*, one for one, are sequentially transferred onto the recording medium S by the electric fields formed between the photoconductive drum 1*a*, 1*b*, 1*c*, 1*d*, and the opposing transfer rollers 12*a*, 12*b*, 12*c*, 12*d*, respectively.

After the transfer of the developer images different in color onto the recording medium S, the recording medium S is separated from the electrostatic transfer belt 11 by the curvature of the drive roller 13, and is conveyed into the fixing portion 20. In the fixing portion 20, the developer images are thermally fixed by the heat roller 21*a* and the pressure roller 21*b*. Then, the recording medium S is discharged from a sheet-discharging portion 24 by a pair of sheet-discharge rollers 23, with the image-bearing surface of the recording medium S facing downward.

Meanwhile, the transfer residual developer, that is, the developer remaining on the peripheral surface of the photoconductive drum 1 (1*a*, 1*b*, 1*c*, 1*d*), is scraped down by the corresponding cleaning apparatus 6 (6*a*, 6*b*, 6*c*, 6*d*); the photoconductive drum 1 is cleaned. As the photoconductive drum 1 (a, 1*b*, 1*c*, 1*d*) is cleaned, the cleaned portion of the peripheral surface of the photoconductive drum 1 (1*a*, 1*b*, 1*c*, 1*d*) becomes usable for the following image-forming process.

Next, referring to FIGS. 2–5, the structure of the process cartridge 7 removably mountable in the main assembly 26 of the image forming apparatus P, and the structure of the cartridge-mounting portion 29 of the main assembly 26 of the image forming apparatus P, will be described.

Figure 3:
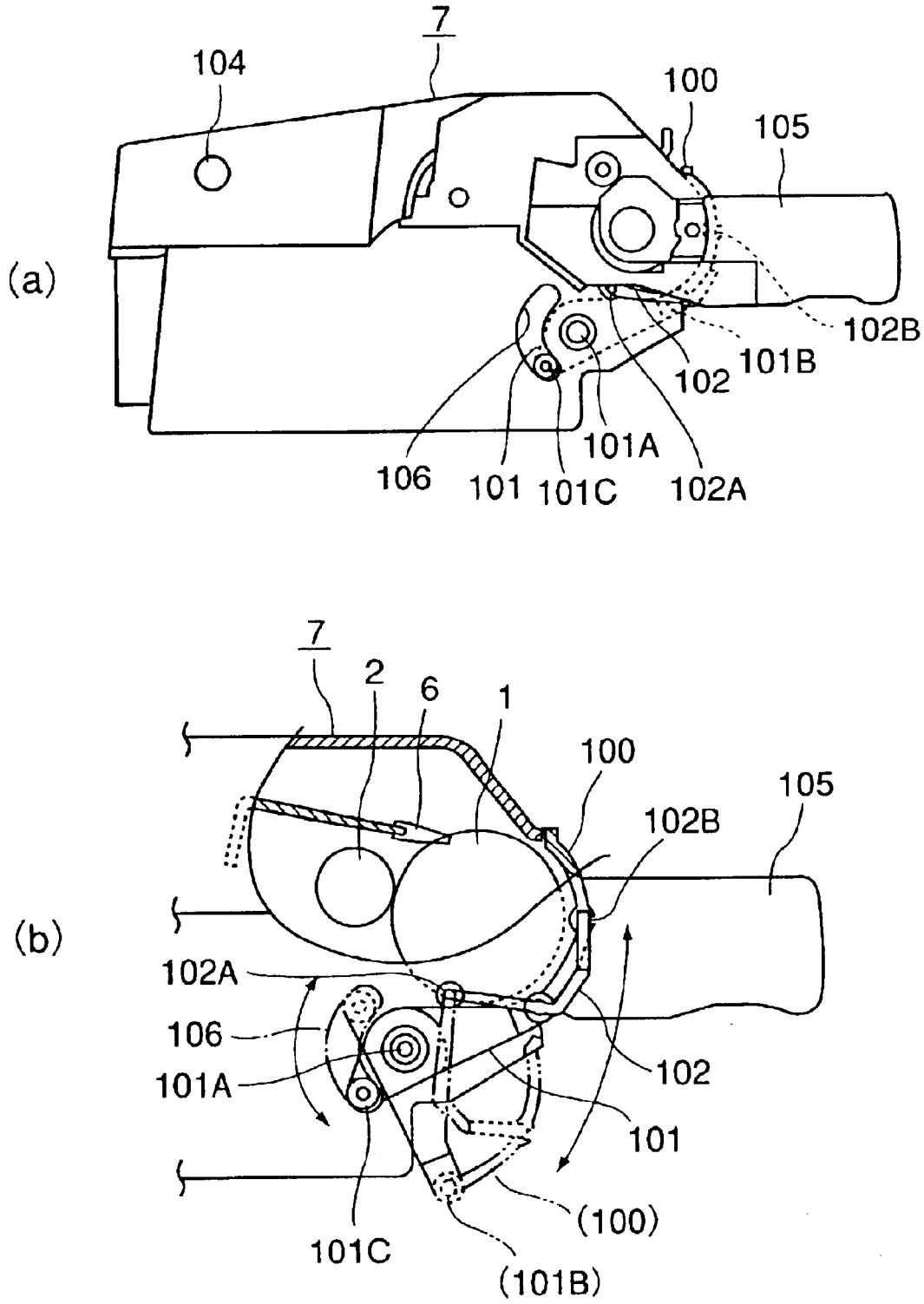
FIG. 3(*a*) is a side view of a process cartridge in accordance with the present invention, and FIG. 3(*b*) is an enlarged and partially broken-away side view of the process cartridge in accordance with the present invention.
Figure 4:
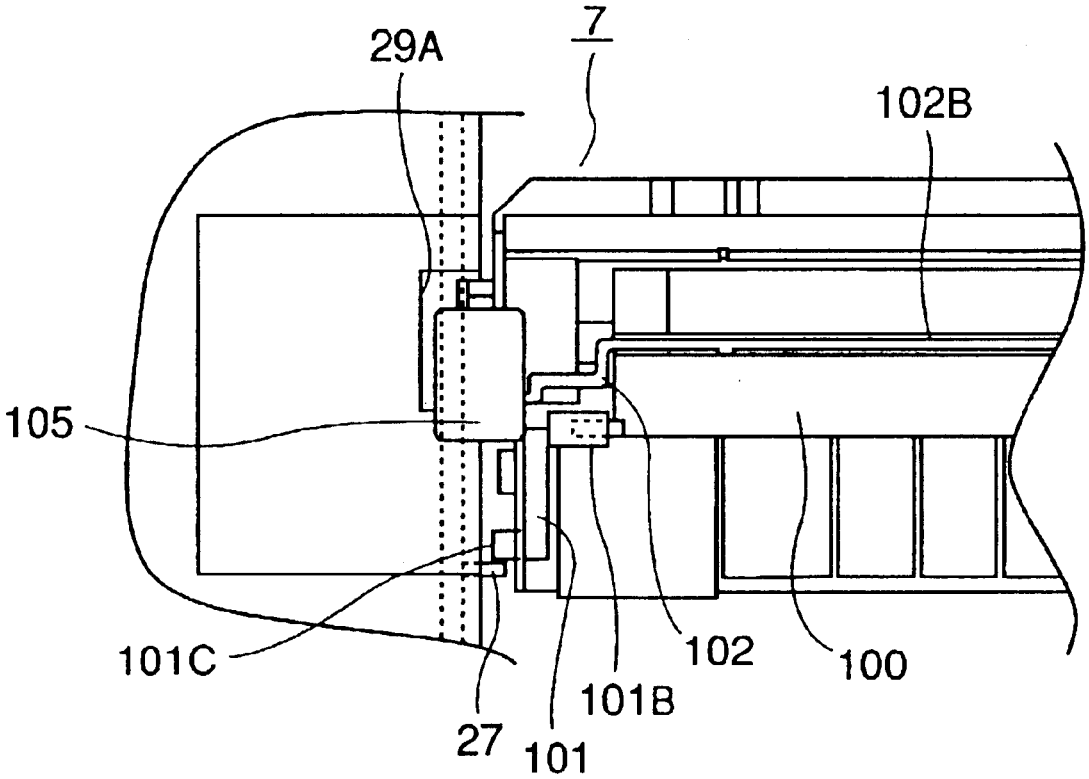
FIG. 4 is a front plan view of one of the lengthwise ends of the process cartridge properly set in a cartridge-mounting portion of the image forming apparatus in accordance with the present invention.
Figure 5:
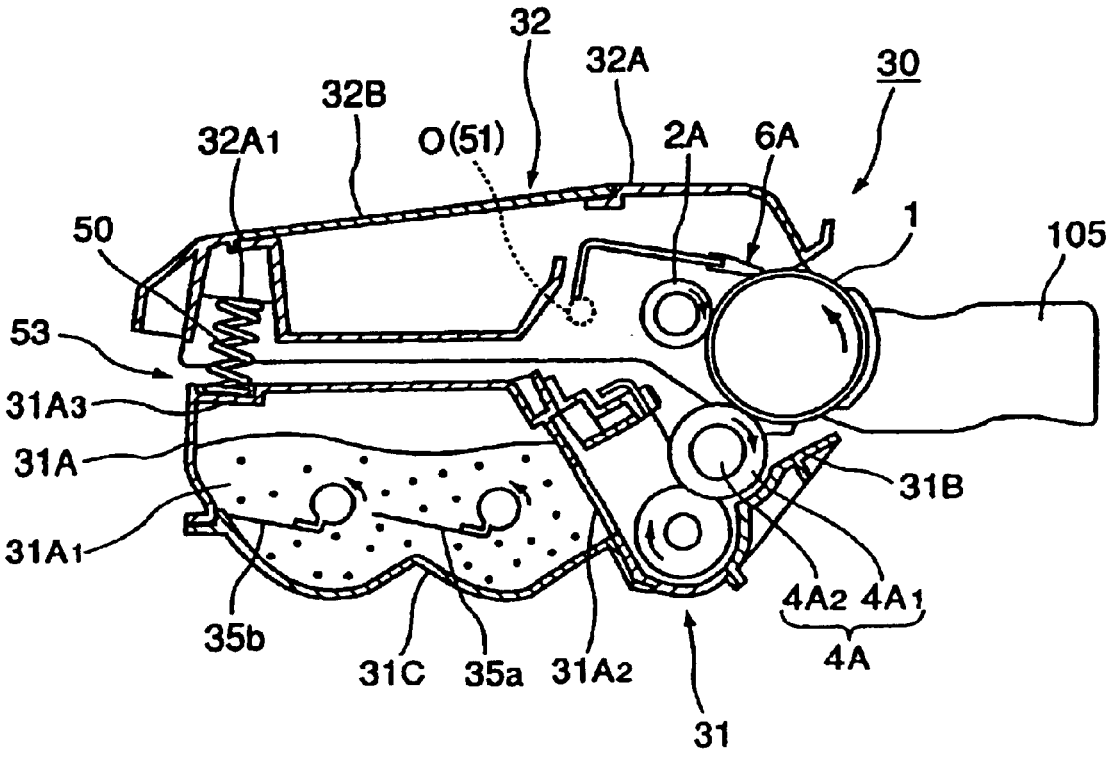
FIG. 5 is a vertical sectional view of the process cartridge in accordance with the present invention.

FIG. 2 is a perspective view of the image forming apparatus P, the front cover 25 of which is open. FIG. 3(*a*) is a side view of the process cartridge 7 in accordance with the present invention, and FIG. 3(*b*) is an enlarged, partially broken-away side view of the drum shutter 100, and its adjacencies, of the process cartridge 7 in accordance with the present invention. FIG. 4 is a front plan view of one of the lengthwise ends of the cartridge-mounting portion 29 of the image forming apparatus P in accordance with the present invention, in which the properly disposed process cartridge 7 is present. FIG. 5 is a vertical sectional view of the process cartridge 7 in accordance with the present invention.

Referring to FIG. 5, the photoconductive drum 1, and the plurality of processing members, that is, the charging apparatus 2, the developing apparatus, the cleaning apparatus 6, and so forth, are disposed, being thereby supported, in a cartridge frame 30 formed by joining a developing-means container 31 and cleaning-means container 32, making up the process cartridge 7. In consideration of the service lives of the processing members, the amount of the developer storable in the developer-storage portion, and the like factors, the process cartridge 7 is designed so that it will be replaced with a fresh one after the formation of a predetermined number of images. Further, the process cartridge 1 is structured so that when it needs to be replaced due to the expiration of the service lives of its processing members, or depletion of the developer therein, or when it is for the first time that the process cartridge 7 is mounted into the image forming apparatus P, the process cartridge 7 can be mounted into, or removed from, the cartridge-mounting portion (29 in FIG. 2) of the image forming apparatus P in a direction perpendicular to the generatrix of the photoconductive drum 1.

Referring to FIG. 2, the main assembly 26 of the image forming apparatus P has a cartridge entrance 28, which is greater in dimension, in terms of the lengthwise direction of the process cartridge 7 (lengthwise direction of photoconductive drum 1), than the process cartridge 7. This cartridge entrance 28 has the front cover 25 and a top cover 25A, which are attached to the main assembly 26 so that they can be opened or closed. The front cover 25 holds the electrostatic transfer belt 11 of the electrostatic transferring apparatus 5, the drive roller 13, the follower rollers 14*a* and 14*b*, the tension roller 15, and transfer rollers (12*a*, 12*b*, 12*c*, 12*d*). Normally, the front and top covers 25 and 25A are closed as shown in FIG. 1 (as indicated by the single-dot chain line in FIG. 2), and when a process cartridge 7 is mounted for the first time, or replaced, they are kept open, exposing the cartridge entrance 28, as shown in FIG. 2; as the front and top covers 25 and 25A are opened, the electrostatic transferring apparatus 5 is moved, exposing the cartridge entrance 28.

Also referring to FIG. 2, the side walls of the cartridge-mounting portion 29 (29*a*, 29*b*, 29*c*, 29*d*), into which the process cartridges 7 are mounted, have cartridge guides 29A (29Aa, 29Ab, 29Ac, 29Ad) and (29Ba, 29Bb, 29Bc, 29Bd); one of the side walls of the cartridge-mounting portion 29 has a plurality (four in FIG. 2) of cartridge guides 29A, and the other side wall has a plurality of cartridge guides 29Ba, 29Bb, 29Bc, 29Bd. The cartridge guides and are disposed in parallel, with the provision of equal intervals. Each of the cartridge-mounting portions 29*a*, 29*b*, 29*c*, 29*d* has a process-cartridge pressing spring (unshown) for setting the corresponding process cartridge 7 into the predetermined position and properly retaining it therein. As the front and top covers 25 and 25A are closed after the mounting of the process cartridge 7 into the cartridge-mounting portion 29 of the main assembly 26, the process cartridge 7 is set into the predetermined position by the pressure from the cartridge-pressing spring. As the process cartridge 7 is set into the predetermined position, the electrostatic transfer belt 11 of the electrostatic transferring apparatus 5 comes into contact with the photoconductive drums 1 (1*a*, 1*b*, 1*c*, 1*d*).

Figure 6:
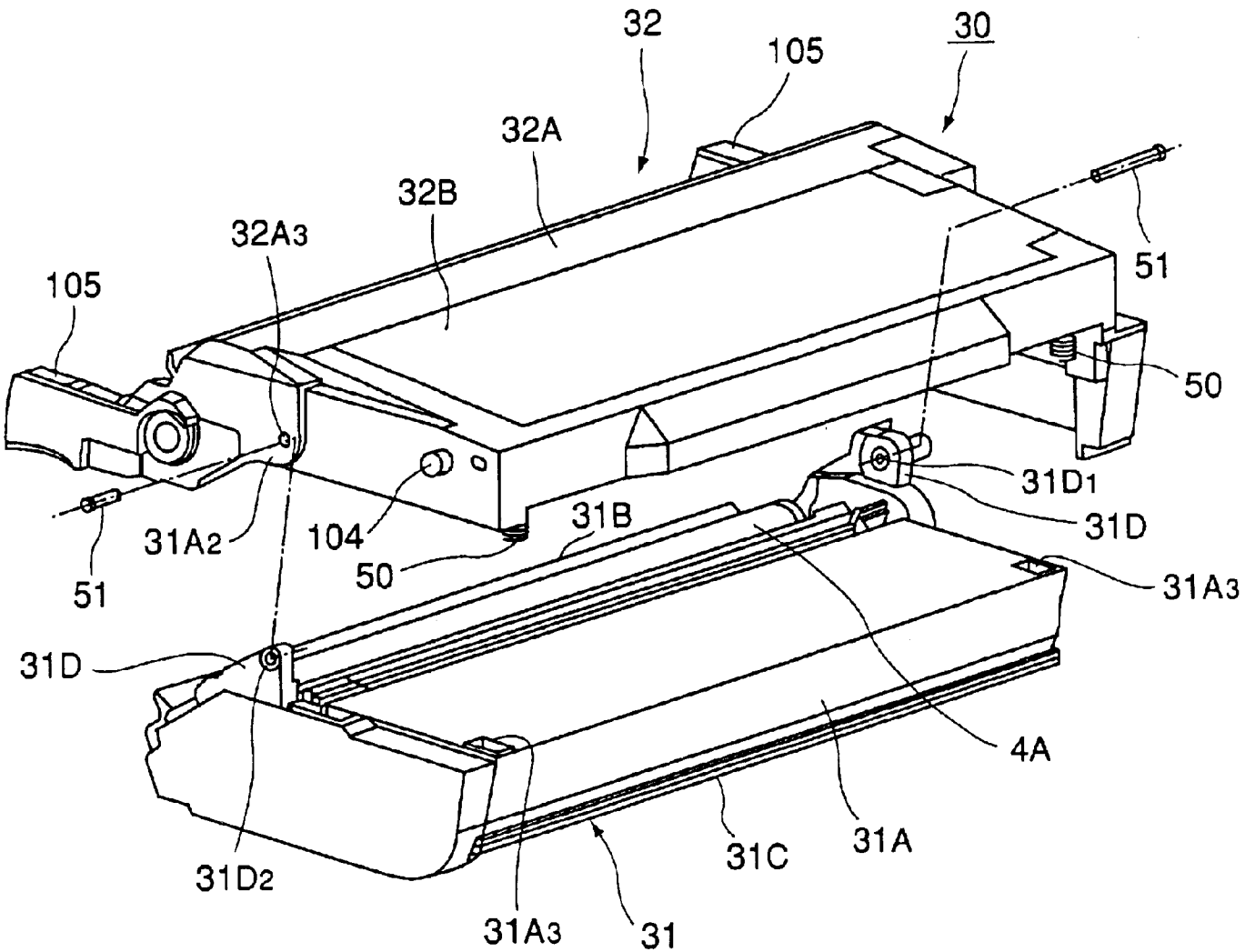
FIG. 6 is a perspective view of a separated combination of a developing-means container (subframe) and a cleaning-means container (subframe).

Referring to FIGS. 3(*a*) and 3(*b*), the process cartridge 7 (7*a*, 7*b*, 7*c*, 7*d*) has a pair of handles 105, which are on the lengthwise ends of the front portion of the process cartridge 7, one for one, (see also FIGS. 5 and 6, and so forth). It also has a pair of guides 104, which project from the lengthwise ends of the rear portion of the process cartridge 7, one for one. Each process cartridge 7 is to be mounted in the following manner into the cartridge-mounting portion 29 of the main assembly 26. A user holds the process cartridge 7 by grasping the handles 105 with his or her hands so that the photoconductive drum 1 is positioned on the front side of the process cartridge 7 in terms of the cartridge-insertion direction. Then, the process cartridge 7 is to be inserted into the cartridge-mounting portion 29, with the guides 104 of the process cartridge 7 resting, and sliding, on the corresponding guides (unshown) on the side walls of the main assembly 26, and the bearing portions rotationally supporting the shaft of the photoconductive drum 1 of the process cartridge 7 resting, and sliding, on the corresponding guides 29Aa, 29Ab, 20Ac, 29Ad and 29Ba, 29Bb, 29Bc, 29Bd (FIG. 2).

If the photoconductive drum 1 in the process cartridge 7 is exposed to ambient light for an extended period of time, its properties deteriorate. Further, if the photoconductive drum 1 is exposed while the process cartridge 7 is handled outside the main assembly 26, there is the possibility that the photoconductive drum 1 will be damaged, or foreign substances will adhere to the peripheral surface of the photoconductive drum 1. Thus, in order to prevent the above-described kinds of deterioration or damage, the process cartridge 7 is provided with the drum shutter 100 for exposing or covering the opening through which the peripheral surface of the photoconductive drum 1 in the frame of the process cartridge 7 is partially exposable. The drum shutter 100 is structured so that as the process cartridge 7 is mounted into the main assembly 26, it opens to expose the photoconductive drum 1. In other words, only when the process cartridge 7 is in the main assembly 26, the drum shutter 100 is open; otherwise, it remains closed.

More specifically, as shown clearly in FIG. 3(*b*), the drum shutter 100 is capable of moving between the blocking position (contoured by the solid line in FIG. 3(*b*)) in which it covers the opening of the frame of the process cartridge 7, through which the photoconductive drum 1 is partially exposable, and the unblocking position (contoured by the two-dot chain line in FIG. 3(*b*)) to which it retracts from the blocking position to expose the opening. The drum shutter 100 is attached to the cartridge frame, with the interposition a shutter arms 101 and a shutter shaft 102, being enabled to move following the contour of the process cartridge 7. The lengthwise ends 102A of the shutter shaft 102 are approximately U-shaped and are rotatably attached to the left (right) side wall of the cartridge frame, with the use of a shaft, being enabled to rotate about the shafts. The center portion 102B of the shutter shaft 102, which extends from one end of the drum shutter 100 and to the other, in terms of the lengthwise direction of the process cartridge 7, is rotatably attached to the center of the drum shutter 100, in terms of the vertical direction of the drum shutter 100, being enabled to rotate relative to the drum shutter 100. The shutter arm 101 is attached, by one end, or the base portion, to the left side wall of the cartridge frame, with the use of a shaft 101A, being enabled to be rotated about the shaft 101A. The other end of the shutter arm 101 is attached to the bottom of the corresponding lengthwise end of the drum shutter 100, with the use of shaft 101B. Therefore, the shutter arm 101 is enabled to rotationally move relative to the drum shutter 100 and the cartridge frame. Further, the base portion of the shutter arm 101 has a projection 101C, which projects outward of the process cartridge 7, that is, leftward, from the shutter arm 101, in the direction perpendicular to the left side wall of the process cartridge 7, through an arcuate slot 106. Further, the shutter arm 101 is structured so that it remains at the blocking position contoured by the solid line in FIG. 3(*b*), being kept pressured by an unshown shutter spring in the counterclockwise direction. Thus, while no force acts upon the projection 101C of the shutter arm 101, for example, when the process cartridge 7 is out of the main assembly 26, the drum shutter 100 is kept in the blocking position, as contoured by the solid line in FIG. 3(*b*), by the pressure from the shutter spring (unshown).

On the other hand, referring to FIG. 4, the cartridge-mounting portion 29 of the main assembly 26 has a shutter-arm moving member 27, which is vertically moved by the closing movement of the front cover 25. Thus, as the front cover 25 is closed after the insertion of the process cartridge 7 into the predetermined cartridge slot of the cartridge-mounting portion 29 of the main assembly 26, the shutter-arm moving member 27 is moved by the closing movement of the front cover 25. As the result, the projection 101C of the shutter arm 101 is moved upward by the upward movement of the shutter-arm moving member 27, rotating the shutter arm 101 clockwise direction about the shaft 10A (FIG. 3(*b*)). Therefore, the end of the shutter arm 101, supported by the shaft 101B, moves downward, rotating drum shutter 100 about the end portions 102A and 102A of the shutter shaft 102, to the unblocking position contoured by the two-dot chain line in FIG. 3(*b*). As a result, the photoconductive drum 1 is partially exposed through the opening.

Next, referring to FIGS. 5–8, the structure of the frame of the process cartridge 7 will be described.

The cartridge frame 30 in this embodiment is formed of polystyrol resin, by injection molding. It comprises the developing-means container 31 and cleaning-means container 32, which are connected with a pair of connecting pins, being enabled to rotate about the pins.

The developing-means container 31 comprises a developer-storage frame 31A, a developing-means holding frame 31B, and a bottom member 31C. The developing-means holding frame 31B is welded to the side of the developer-storage frame 31A, and the bottom member 31C is welded to the bottom portion of the welded combination of the developing-means holding frame 31B and developing-means holding frame 31A. A pair of developer-conveying members (35*a* and 35*b*) are disposed within the developer-storage portion $\mathbf{31A_1}$ of the developer-storage frame 31A. The developer in the developer-storage portion $\mathbf{31A_1}$ is conveyed into the developing-means holding frame 31B through a developer-delivery opening $\mathbf{31A_2}$, and then, is supplied to a development roller 4A (developing apparatus) in the developing-means holding frame 31B. Disposed also in the developer-storage fame 31A are a plurality of upright supporting members, extending in the lengthwise direction of the developer-storage frame 31A.

On the other hand, the cleaning-means container 32 comprises a cleaning-means holding frame 32A, and a cover 32B welded to the top portion of the cleaning-means holding frame 32A. Attached within the cleaning-means container 32 are various members and components, which make up the photoconductive drum 1, the charge roller 2A (charging apparatus 2), the cleaning means 6A (cleaning apparatus 6), and so forth. The developing-means container 31, in which the various members of the developing means are disposed, and the cleaning-means container 32, in which the photoconductive drum 1, the cleaning means, and so forth are disposed, are connected to each other, using a pair of arm portions 31D and 31D (FIG. 6) of the developing-means container 31, which are the lengthwise end portions of the developing-means container 31, making up the cartridge frame 30 (that is, process cartridge 7).

Next, referring to FIGS. 6–8, the structure of the connective portions of the developing-means container 31 and cleaning-means container 32, will be described in more detail.

The developing-means container 31 has the pair of arm portions 31D and 31D, which are located at the lengthwise ends of the developing-means container 31. The end of each arm portion 31D has a round through hole $\mathbf{31D_1}$, or an elongated through hole $\mathbf{31D_2}$, through which a pin 51 is put. The pin 51 will be described later. The developing-means container 31 and the cleaning-means container 32 are connected to each other by the arm portions 31D and 31D of the developing-means container 31, and the corresponding portions of the cleaning-means container 32, with the use of the pins 51, allowing the two containers 31 and 32 to pivot about the pins 51.

Referring to FIG. 5, the cleaning-means holder frame 32A has a pair of spring mounts $\mathbf{32A_1}$, which are integral parts of the cleaning-means holding frame 32A, and to which a pair of compression-coil springs 50 are attached, one for one. The compression-coil springs 50 are at the lengthwise ends of the cleaning-means holding frame 32A, being apart from, in terms of the widthwise direction of the process cartridge 7, and parallel to, the arm portions 3 ID. Referring to FIG. 7, the outward side wall $\mathbf{32A_2}$ of the cleaning-means holding frame 32A has a hole $\mathbf{32A_3}$, through which a pin 51 is put, whereas the inward side wall 32A4 of the cleaning-means holding frame 32A has a hole $\mathbf{32A_5}$, into which the pin 51 is pressed, being anchored to the cleaning-means holding frame 32A. The axes of the holes $\mathbf{32A_3}$ and $\mathbf{32A_5}$ are parallel to the axis of the photoconductive drum 1.

Figure 7:
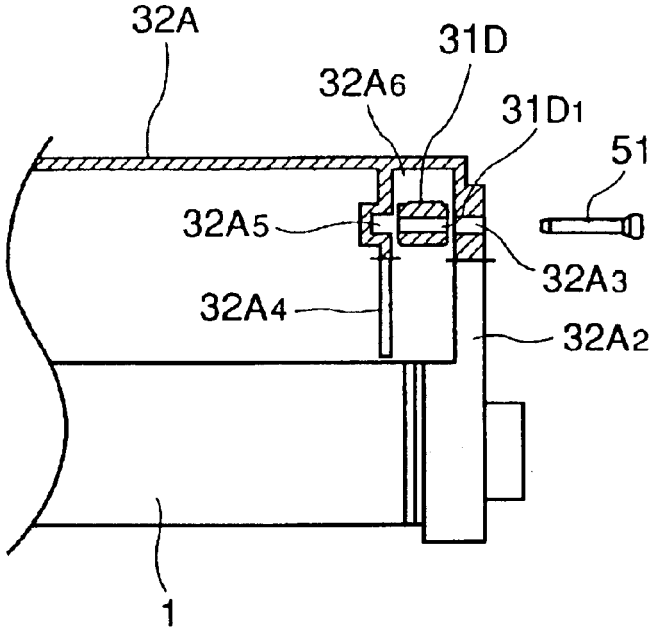
FIG. 7 is a sectional view of a joint, and its adjacencies, between the developing-means container and the cleaning-means container of the process cartridge in accordance with the present invention.
Figure 8:
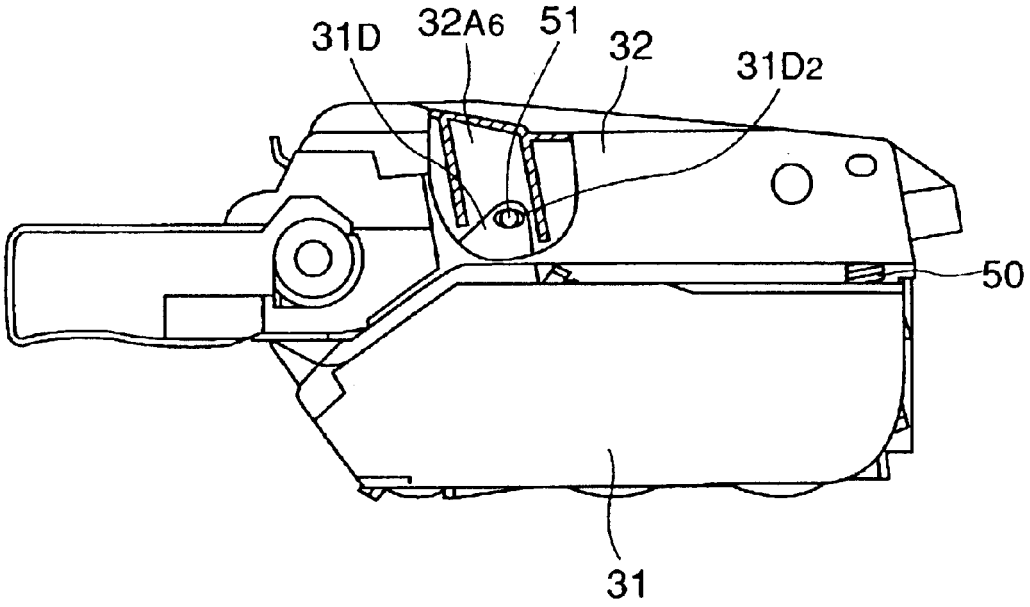
FIG. 8 is a partially broken-away side view of the joint, and its adjacencies, between the developing-means container and the cleaning-means container of the process cartridge in accordance with the present invention.

Referring to FIGS. 6–8, the developing-means container 31 and the cleaning-means container 32 structured as described above are connected in the following manner. First, the arm portions 31D of the developing-means container 31 are inserted into recesses $\mathbf{32A_6}$ of the cleaning-means container 32, one for one, so that the axial lines of the hole $\mathbf{31D_1}$ or $\mathbf{31D_2}$ of the arm portions 31D located at the lengthwise ends of the developing means container 31, coincide with the axial lines of the hole $\mathbf{32A_3}$ and $\mathbf{32A_5}$ of the cleaning-means container 32. Then, the pins 51 are put through the hole $\mathbf{32A_3}$ of the cleaning-means container 32, hole 31D, (or elongated hole $\mathbf{31D_2}$) of the arm portions 31D, and are pressed into the holes $\mathbf{32A_5}$ of the inward side walls $\mathbf{32A_4}$, one for one. As a result, the developing-means container 31 and the cleaning-means container 32 are connected, being enabled to rotate about the pins 51.

As the two containers 31 and 32 are connected, the compression springs 50 attached to the cleaning-means holding frame 32A come into contact with the corresponding spring mounts of $\mathbf{31A_3}$ of the developer storage frame 31A of the developing-means container 31, and are compressed thereafter. Therefore, the photoconductive drum 1 and development roller 4A are kept pressed toward each other by the moment generated by the compression springs 50 in a manner to rotate the two containers 31 and 32 about the pins 51, that is, the center (O), as shown in FIG. 5. As a result, a pair of rings $\mathbf{4A_3}$ (FIG. 9(*a*)), which are fitted around the lengthwise end portions of the development roller 4A, one for one, and the external diameters of which are the same as, or smaller than, that of the development roller 4A, are pressed on the peripheral surface of the photoconductive drum 1. In other words, the developing-means container 31 is pivoted about the pins 51 (O) by the pressure from the compression-coil springs 50, causing the development roller 4A to move in a manner to orbit toward the photoconductive drum 1 about the pins 51 (O). As a result, the rubber layer, that is, surface layer $\mathbf{4A_1}$, of the development roller 4A comprising two layers, that is, the metallic core $\mathbf{4A_2}$ and an elastic layer $\mathbf{4A_1}$ formed of rubber or the like, as shown in FIG. 5, is compressed enough for the rings $\mathbf{4A_3}$ to come into contact with the peripheral surface of the photoconductive drum 1, forming the contact area (which hereinafter will be referred to as nip) in which a latent image on the peripheral surface of the photoconductive drum 1 can be developed.

As described above, the hole of one of the arm portions 31D, through which the pin 51 for connecting the developing-means container 31 and cleaning-means container 32 so that they can be rotated about the pin 51 is put, is formed as an elongated hole $31D_2$. Therefore, the photoconductive drum 1 and the development roller 4A (as well as rings $4A_3$) contact each other by their generatrices, which are parallel to the axial lines of the photoconductive drum 1 and development roller 4A.

Figure 9:
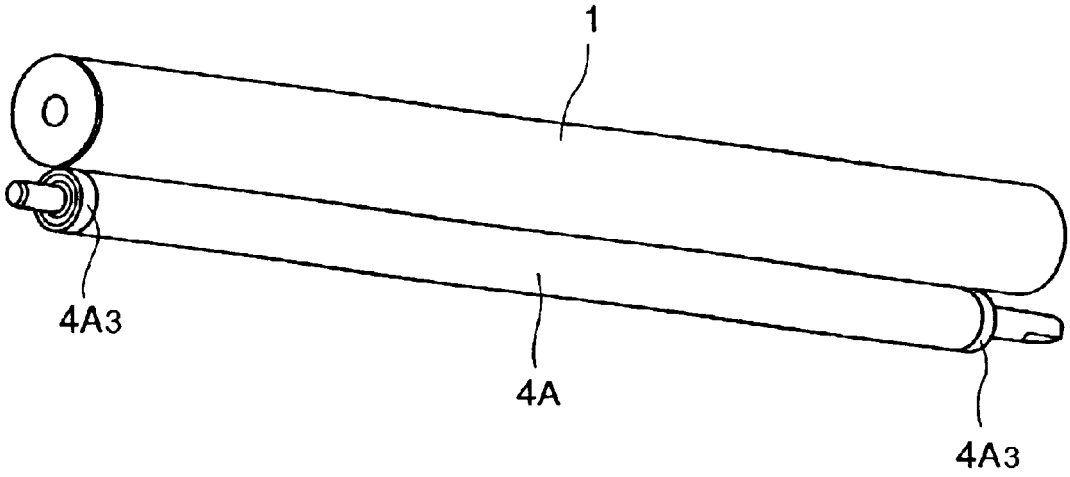
FIG. 9 is a perspective view of a combination of a photoconductive drum and a development roller in a process cartridge in accordance with the present invention, for showing their relationship, FIGS. 9(*a*) and 9(*b*) showing the relationships thereof during image formation and shipment, respectively.
Figure 9:
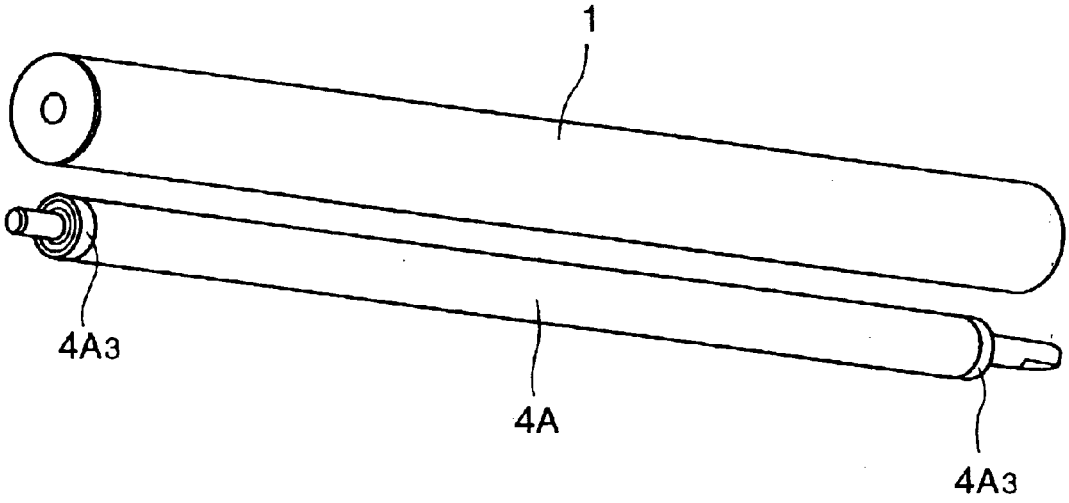

The process cartridge 7 is made by connecting the developing-means container 31 and the cleaning-means container 32 with the pair of connecting pins 51 so that the two containers 31 and 32 can rotate about the pins 51, with the pair of compression springs 50 placed between the opposite portions of the two containers 31 and 32, in terms of the widthwise direction of the process cartridge 7, with respect to where the pair of connecting pins 51 are, to the side where the photoconductive drum 1 and the development roller 4A are kept in contact with each other as shown in FIGS. 5 and 9(*a*). If the photoconductive drum 1 and the development roller 4A are kept in contact with each other, as shown in FIGS. 5 and 9(*a*), for a long period of time between the shipping of the process cartridge 7 after the manufacture of the process cartridge 7, and the mounting of the process cartridge 7 into the image forming apparatus main assembly, it is possible, in the worst case, that the portion of the development roller 4A in the nip, that is, the portion of the development roller 4A in contact with the photoconductive drum 1, will conform in shape to the contour of the peripheral surface of the photoconductive drum 1.

Therefore, in this embodiment, such a structural arrangement is made that during the shipping of the process cartridge 7, the distance between the axial lines of the photoconductive drum 1 and development roller 4A in the process cartridge 7 can be kept greater than that during an image-forming operation, or that during the shipping of the process cartridge 7, the photoconductive drum 1 and the development roller 4A in the process cartridge 7 can be kept apart from each other as shown in FIG. 9(*b*).

Figure 10:
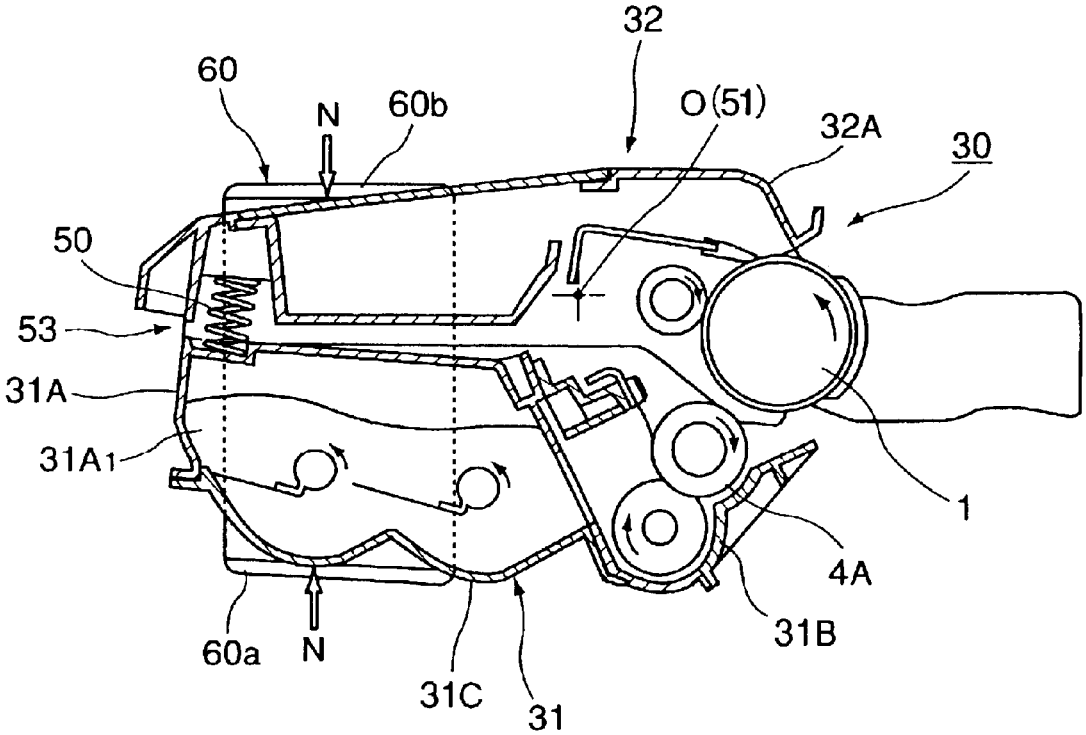
FIG. 10 is a sectional view of a process cartridge in accordance with the present invention, which has a gap-maintaining member for maintaining a predetermined gap between a photoconductive drum and a development roller during the shipment of the process cartridge.
Figure 11:
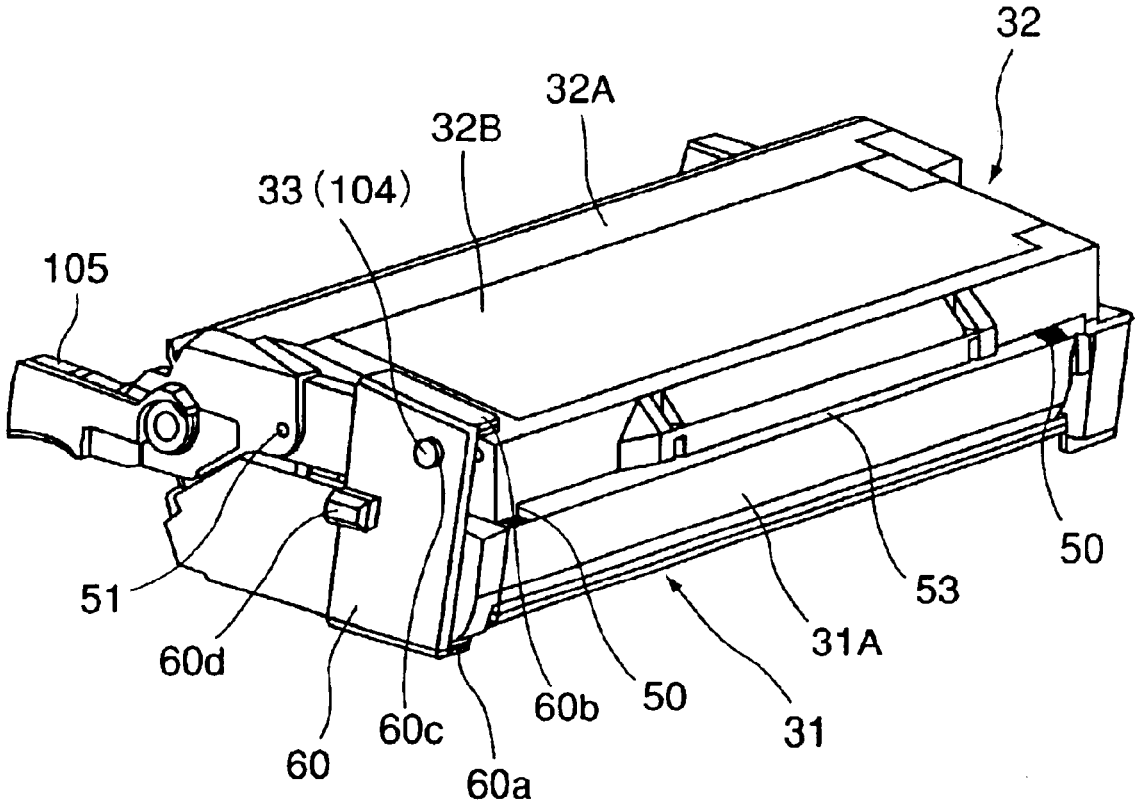
FIG. 11 is a perspective view of the process cartridge in accordance with the present invention, which has a gap-maintaining member for maintaining a predetermined gap between the photoconductive drum and the development roller during the shipment of the process cartridge.
Figure 12:
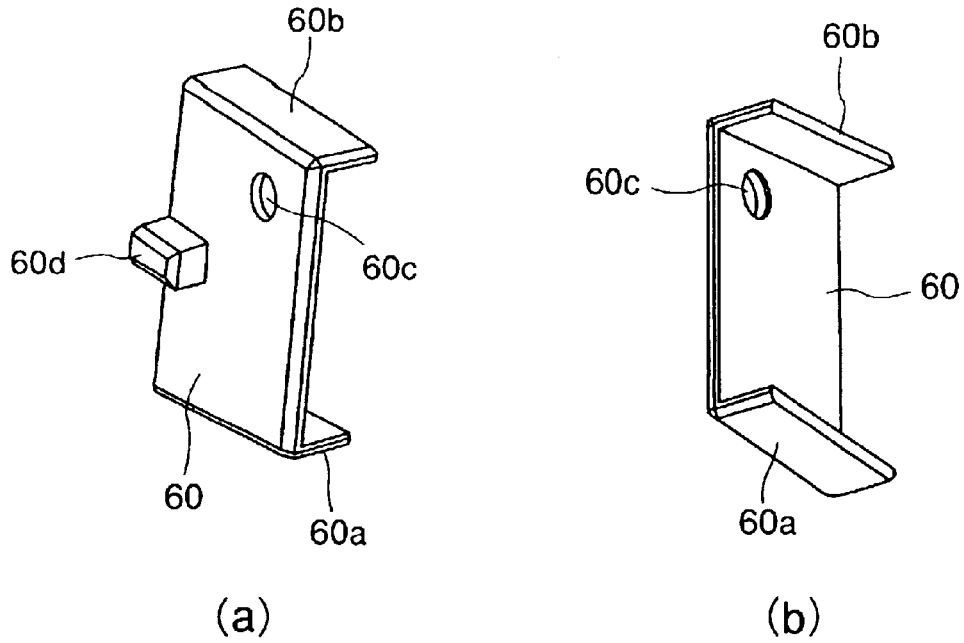
FIG. 12 is a perspective view of the gap-maintaining member of the process cartridge in accordance with the present invention, FIGS. 12(*a*) and 12(*b*) showing one side of the gap-maintaining member, and the other, respectively.

Referring to FIGS. 10–12, described next will be a gap-maintaining means for maintaining an increased distance between the axial lines of the photoconductive drum 1 and the development roller 4A, or for keeping the photoconductive drum 1 and the development roller 4A separated from each other.

The embodiment of a gap-maintaining means shown in FIGS. 10–12 employs a gap-maintaining member for clamping the process cartridge 7 by the portions of the developing-means container 31 and the cleaning-means container 32, on the side opposite to where the photoconductive drum 1 and the development roller 4A are, for keeping the photoconductive drum 1 and the development roller 4A separated from each other.

The photoconductive drum 1 and the development roller 4A are supported by the cartridge frame 30. Thus, the photoconductive drum 1 and the development roller 4A can be separated from each other by applying a force in the direction indicated by an arrow mark N in FIG. 10, against the resiliency of the pair of compression-coil springs 50, so that the developing-means container 31 and the cleaning-means container 32 come closer to each other, on the side opposite to the side where the photoconductive drum 1 and the development roller 4A are, with reference to the vertical plane which coincides with the axial lines of the pins 51 connecting the developing-means container 31 and cleaning-means container 32. Thus, in order to separate the photoconductive drum 1 and the development roller 4A from each other, a gap-maintaining member 60 capable of applying a force in the direction indicated by the arrow mark N in FIG. 10 is attached to the developing-means container 31 and the cleaning-means container 32, as shown in FIGS. 10 and 11. While the gap-maintaining member 60 keeps the photoconductive drum 1 and the development roller 4A separated from each other, the tensile force resulting from the compression-coil springs 50 acts on the gap-maintaining member 60. Therefore, the gap-maintaining member 60 needs to be made wide and thick enough for the gap-maintaining member 60 to withstand the amount of the stress generated during shipping by the tensile force from the compression-coil springs 50.

Referring to FIGS. 10–12, in order to apply a force in the direction to cause the developer-means container 31 and the cleaning-means container 32 to come close to each other against the resiliency of the compression-coil springs 50 the gap-maintaining member 60 is provided with a downward-rotation regulation member 60*a* for regulating the rotational movement of the developing-means container 31 in the direction opposite to the direction indicated by the arrow mark N, and an upward-rotation regulation member 60*b* for regulating the rotational movement of the cleaning-means container 32 also in the direction opposite to the direction indicated by the arrow mark N.

In order to prevent the gap-maintaining member 60 from becoming disengaged from the cleaning-means container 32, the gap-maintaining member 60 is also provided with a recess (or projection) 60*c*, which engages with the projection (or recess) 33 of the cleaning-means container 32. The projection 33 or 60*c* projects in the direction roughly parallel to the direction in which the gap-maintaining member 60 is to be moved when disengaging the gap-maintaining member 60 from the process cartridge 7, and prevents the gap-maintaining member 60 from moving in the direction parallel to the vertical plane coinciding with the axial lines O of the pins 51 connecting the developing-means container 31 and the cleaning-means container 32. Incidentally, the guides 104 (FIGS. 3(*a*) and 6) can be utilized as the projection 33 of the cleaning-means container 32.

Further, the gap-maintaining member 60 is provided with a knob 60*d*, which is on a surface different from the surface which makes contact with the developing-means container 31 and the cleaning-means container 32. With the provision of this knob 60*d*, the gap-maintaining member 60 can be easily attached or removed. Further, this knob 60*d* can be utilized as a projection for ensuring that when the gap-maintaining member 60 is on the process cartridge 7, the overall dimension L2 of the process cartridge 7 in terms of its lengthwise direction is greater than the length L1 the opening of the cartridge-mounting portion 29 of the image forming apparatus main assembly 26.

The distance between the axial lines of the development roller 4A and the photoconductive drum 1 in the process cartridge 7 can be increased to a predetermined value and maintained at the increased value, or the photoconductive drum 1 and the development roller 4A can be separated and kept separated, by attaching the gap-maintaining member 60 structured as described above to the cartridge frame 30, as shown in FIGS. 10 and 11, after the completion of the manufacture of the process cartridge 7. The process cartridge 7 is shipped out in this state. The above-described deformation of the development roller 4A in which the development roller 4A conforms in shape to the contour of the peripheral surface of the photoconductive drum 1 can be prevented by shipping the process cartridge 7 while keeping the distance between the development roller 4A and the photoconductive drum 1 at an increased value, or by keeping the development roller 4A and the photoconductive drum 1 separated from each other. In addition, while a gap-maintaining member, such as the above described gap-maintaining member 60 is on the process cartridge 7, an exposure opening 53 for allowing the image-formation light to reach the photoconductive drum 1 remains closed (FIG. 10). Therefore, it becomes virtually-impossible for the photoconductive drum 1 to become exposed to ambient light during the shipping of the process cartridge 7, because the exposure-opening portion of the process cartridge 7 is also covered with the drum shutter 100.

The gap-maintaining member 60 is to be removed from the process cartridge 7 by grasping the knob 60*d*, prior to mounting the process cartridge 7 into the a main assembly 26. As the gap-maintaining member 60 is removed, the developing-means container 31 and the cleaning-means container 32 are made to rotate about the pins 51 by the resiliency of the compression-coil springs 50. As a result, the development roller 4A and the photoconductive drum 1 are pressed upon each other, and at the same time, the rings $4A_3$ of the development roller 4A are pressed on the photoconductive drum 1. Further, the exposure opening 53 opens (widens) as shown in FIG. 5, making it possible for the image-formation light to reach the photoconductive drum 1. After the process cartridge 7 has realized the above-described state, it can and is intended to be inserted into the a main assembly 26 so that it is properly mounted in the predetermined cartridge slot of the cartridge-mounting portion 29 of the main assembly 26.

If an attempt is made to insert the process cartridge 7 into the predetermined cartridge slot of the cartridge-mounting portion 29 of the main assembly 26 without removing the gap-maintaining member 60 from the process cartridge 7, the knob 60*d* projecting outward of the process cartridge 7 comes into contact with the side wall of the cartridge-mounting portion 29, preventing the process cartridge 7 from being inserted further. In other words, the knob 60*d* of the gap-maintaining member 60 can be utilized as the projection for assuring that when the gap-maintaining member 60 is on the process cartridge 7, the overall dimension L2 of the process cartridge 7 in terms of its lengthwise direction is greater than the length L1 of the opening of the cartridge-mounting portion 29 of the image forming apparatus main assembly 26; it can be utilized as a stopper for preventing an insertion error. Further, in order to warn a user, a warning label, stating that the gap-maintaining member 60 is to be removed prior to the mounting of the process cartridge 7 into the main assembly 26, may be placed on a part of the surface area of the gap-maintaining member 60 visible from outside.

Next, referring to FIGS. 13–15, another embodiment of a member in accordance with the present invention for maintaining a gap between the photoconductive drum 1 and development roller 4A in a process cartridge 7 will be described. The members, portions, and the like, in this embodiment, which are the same as those in the preceding embodiment of the present invention, will be given the same reference signs as those in the preceding embodiment, and their details will not be described.

A gap-maintaining member 62 in this embodiment is provided with a downward-rotation regulating portion 62*a* and upward-rotation regulating portion 62*e*. The downward-rotation regulating portion 62*a* is for regulating the rotational movement of the developing-means container 31 in the direction opposite to the direction indicated by the arrow mark N in FIG. 13. The upward-rotation regulating portion 62*e* is for regulating the rotational movement of the cleaning-means container 32 in the direction opposite to the direction indicated by the arrow mark N, and is inserted into an upward-rotation regulating-portion catch 34 of the cleaning-means container 32. The gap-maintaining member 62 is structured to apply a force to the developing-means container 31 and the cleaning-means container 32 in the direction to cause the developing-means container 31 and the cleaning-means container 32 to move closer to each other against the resiliency of the compression-coil springs 50. In order to prevent the gap-maintaining member 62 from becoming disengaged from the cleaning-means container 32, by preventing the gap-maintaining member 62 from moving in the direction parallel to the vertical plane coinciding with the axial lines O of the pins 51 connecting the cleaning-means container 32 and the developing-means container 31, the cleaning-means container 32 is provided with a projection (or recess) 33, which is roughly parallel to the direction in which the gap-maintaining member 62 is removed, whereas the gap-maintaining member 62 is provided with a recess (or projection ( ) 62*c* which engages with the projection (or recess) 33 of the cleaning-means container 32. Incidentally, it is possible to utilize the guides 104 (FIGS. 3(*a*) and 6) as the projection 33 of the cleaning-means container 32, as was possible in the preceding embodiment.

Further, the gap-maintaining member 62 is provided with a knob 62*d*, which is on the surface different from the surface which makes contact with the developing-means container 31 and the cleaning-means container 32. With the provision of this knob 62*d*, the gap-maintaining member 62 can be easily attached or removed.

The distance between the axial lines of the development roller 4A and the photoconductive drum 1 in the process cartridge 7 can be increased to a predetermined value and maintained at the increased value, or the photoconductive drum 1 and the development roller 4A can be separated and kept separated, by attaching the gap-maintaining member 62 structured as described above to the cartridge frame 30, as shown in FIGS. 13–15, after the completion of the manufacture of the process cartridge 7. The process cartridge 7 is shipped out in this state. The above-described deformation of the development roller 4A in which the development roller 4A conforms in shape to the contour of the peripheral surface of the photoconductive drum 1 can be prevented by shipping the process cartridge 7 while keeping the distance between the development roller 4A and the photoconductive drum 1 at an increased value, or keeping the development roller 4A and the photoconductive drum 1 separated from each other. In addition, while a gap-maintaining member, such as the above-described gap-maintaining member 62 is on the process cartridge 7, the exposure opening 53 for allowing the image-formation light to reach the photoconductive drum 1 remains closed. Therefore, it is virtually impossible for the photoconductive drum 1 to become exposed to ambient light during the shipping of the process cartridge 7, because the exposure-opening portion of the process cartridge 7 is also covered with the drum shutter 100.

The gap-maintaining member 62 is to be removed from the process cartridge 7 by grasping the knob 62*d*, prior to mounting the process cartridge 7 into the main assembly 26. As the gap-maintaining member 62 is removed, the developing-means container 31 and the cleaning-means container 32 are made to rotate about the pins 51 by the resiliency of the compression-coil springs 50. As a result, the development roller 4A and the photoconductive drum 1 are pressed upon each other, and at the same time, the rings $4A_3$ of the development roller 4A are pressed on the photoconductive drum 1. Further, the exposure opening 53 opens (widens) as shown in FIG. 5, making it possible for the image-formation light to reach the photoconductive drum 1. After the realization of the above-described state by the process cartridge 7, it can and is intended to be inserted into the main assembly 26 so that it is properly mounted in the predetermined cartridge slot of the cartridge-mounting portion 29 of the main assembly 26.

Figure 16:
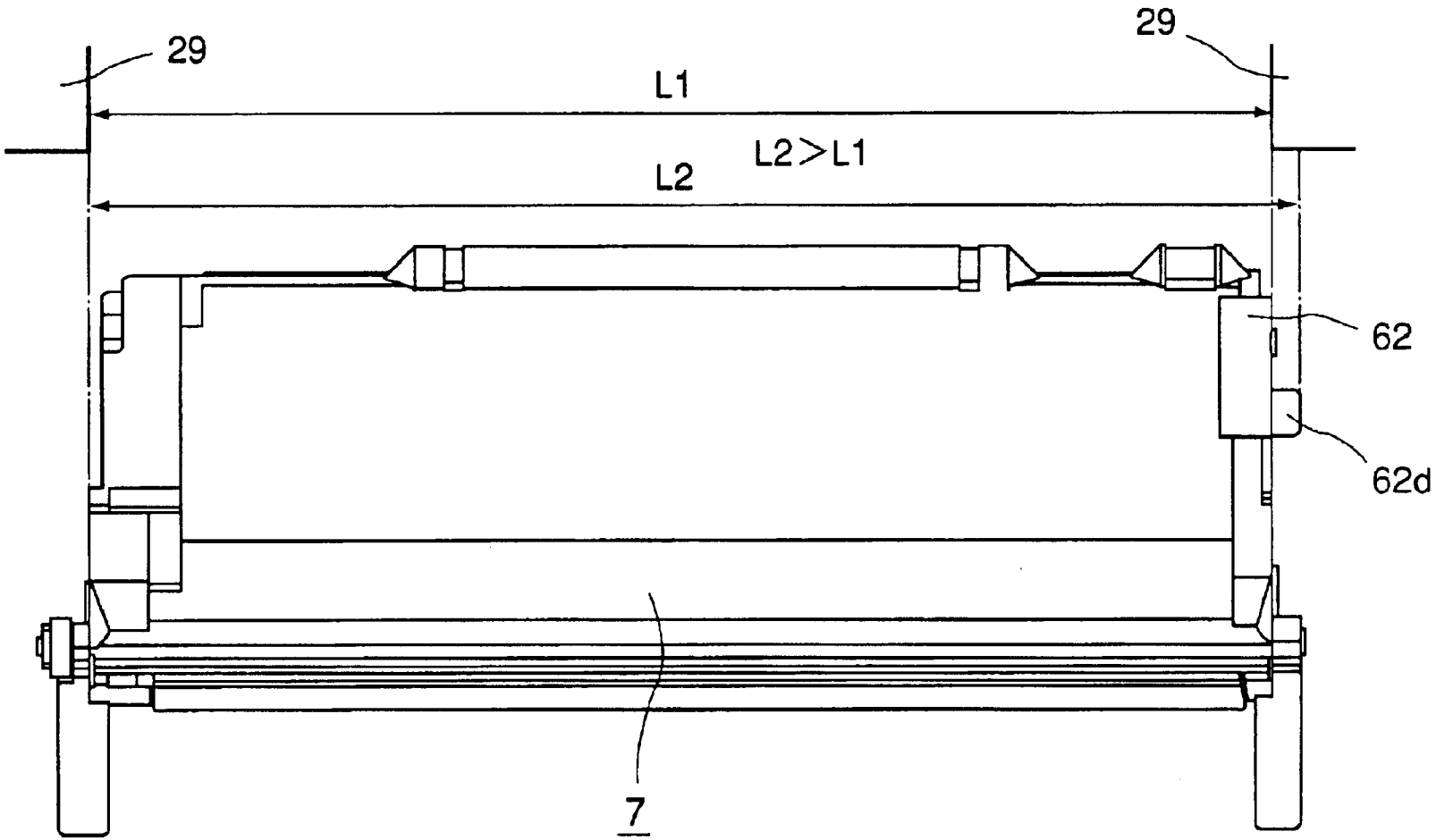
FIG. 16 is a schematic drawing for describing the relationship between the process cartridge, in accordance with the present invention, having a gap-maintaining member, and the cartridge-mounting portion of the main assembly of an image forming apparatus.

If an attempt is made to insert the process cartridge 7 into the predetermined cartridge slot of the cartridge-mounting portion 29 of the main assembly 26 without removing the gap-maintaining member 62 from the process cartridge 7, the knob 62*d* projecting outward of the process cartridge 7 comes into contact with the side wall of the cartridge mounting portion 29, as shown in FIG. 16, preventing the process cartridge 7 from being inserted further. In other words, the knob 62*d* of the gap-maintaining member 62 can be utilized as a stopper for preventing insertion error. Further, in order to warn a user, a warning label, stating that the gap-maintaining member 62 is to be removed prior to the mounting of the process cartridge 7 into the main assembly 26, may be placed on a part of the surface area of the gap-maintaining member 62 visible from outside.

Figure 13:
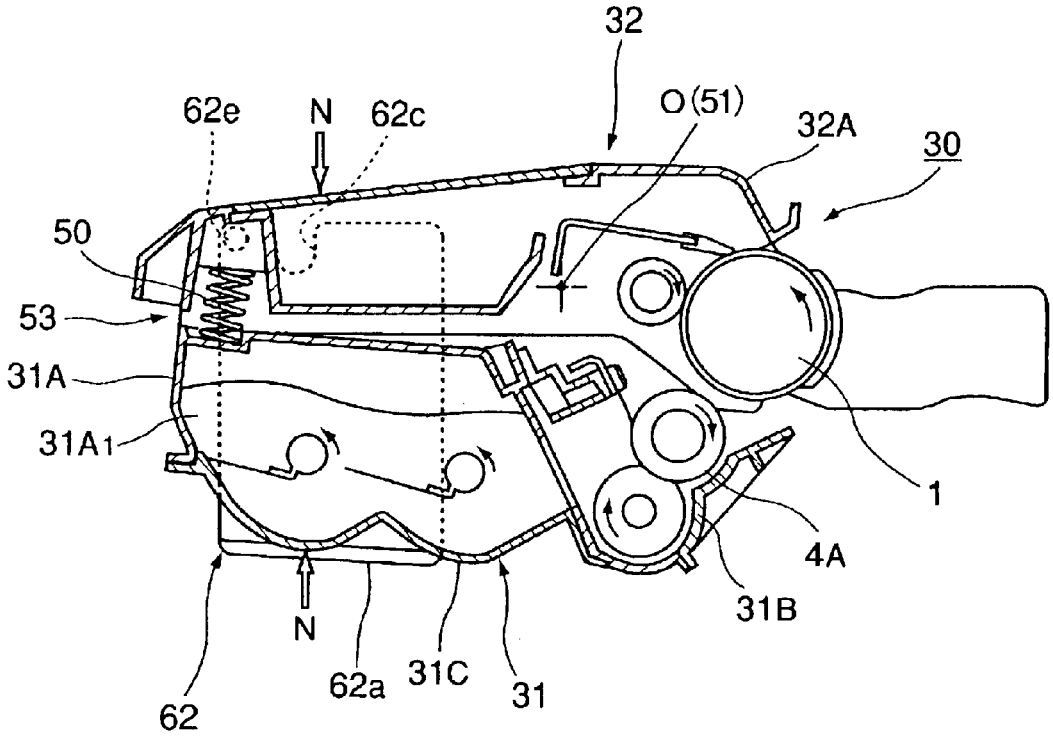
FIG. 13 is a sectional view of the process cartridge in accordance with the present invention, which shows another (second) embodiment of a gap-maintaining member in accordance with the present invention for maintaining a predetermined gap between the photoconductive drum and the development roller during the shipment of the process cartridge.
Figure 14:
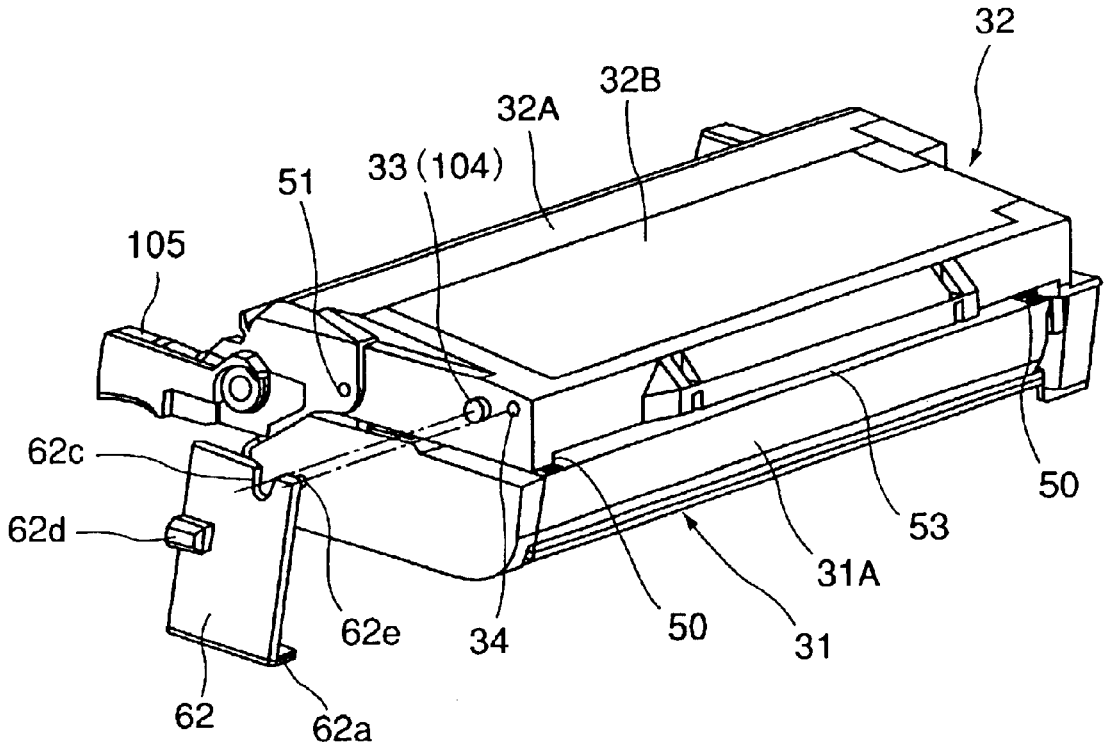
FIG. 14 is a perspective view of the process cartridge in accordance with the present invention, which shows the second embodiment of a gap-maintaining member in accordance with the present invention for maintaining a predetermined gap between the photoconductive drum and the development roller during the shipment of the process cartridge.
Figure 15:
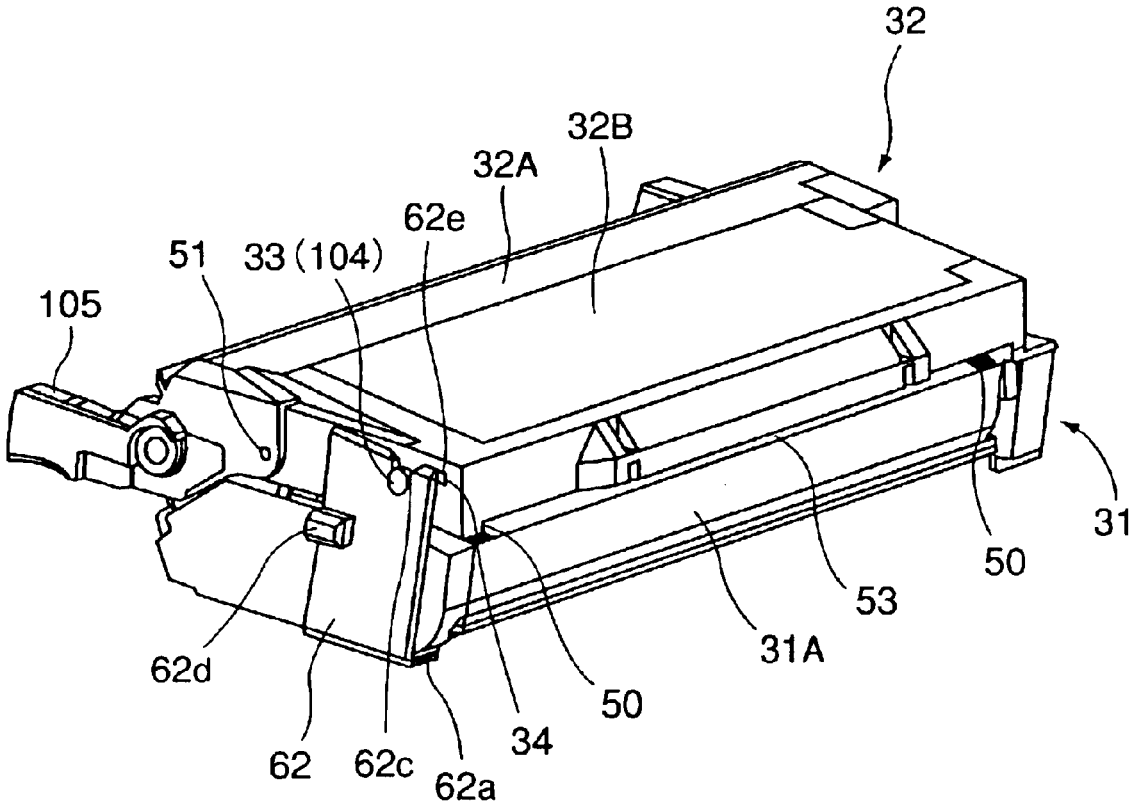
FIG. 15 is a perspective view of the process cartridge in accordance with the present invention, which has the second embodiment of a gap-maintaining member in accordance with the present invention for maintaining a predetermined amount of gap between the photoconductive drum and the development roller during the shipment of the process cartridge.

In FIGS. 13–15, the upward-rotation regulating member catch 34 of the cleaning-means container 32 is in the form of a recess, and the upward-rotation regulation member 62*e* is in the form of a projection. However, the upward-rotation regulating-member catch 34 may be in the form of a projection while forming the upward-rotation regulating portion 62*e* as a recess. Further, the upward-rotation regulating member catch 34 either in the form of a projection or recess may be placed on the developer-means container 31, or the preceding two different structural arrangements regarding the upward-rotation regulating portion and catch maybe employed in combination.

According to an aspect of the present invention, there is provided a process cartridge detachably mountable to a main assembly of an image forming apparatus. The apparatus comprises an electrophotographic photosensitive drum, a developing roller for developing an electrostatic latent image formed on the electrophotographic photosensitive drum with a developer, a first frame supporting the electrophotographic photosensitive drum, a second frame supporting the developing roller, a coupling member for coupling the first frame and the second frame such that the developing roller and the electrophotographic photosensitive drum are contacted to each other or are spaced from each other; an urging member for urging the electrophotographic photosensitive drum and the developing roller toward each other, and a spacer member for maintaining a state in which the electrophotographic photosensitive drum and the developing roller are spaced from each other or in which a distance between centers of the electrophotographic photosensitive drum and the developing roller is larger than a distance therebetween during an image forming operation. The spacer member supports the first frame and second frame at least at longitudinally extending surfaces of the process cartridge, and is detachable from the process cartridge.

In the process cartridge, the coupling member may be a pin.

It is preferable that the spacer member may apply forces to the first frame and the second frame toward each other at positions across a pin coupling the first frame and the second frame with each other from the developing roller.

It is preferable in the process cartridge that the first frame and the second frame are coupled by a pin for rotation relative to each other about the pin. The spacer member has a first limiting for limiting a rotation in one direction and a second limiting portion for limiting a rotation in a direction opposite to the one direction.

It is preferable in the process cartridge that the first frame and the second frame are coupled by a pin for rotation relative to each other about the pin. The spacer member has a first limiting portion for limiting a rotation in one direction, a second limiting portion for limiting a rotation in a direction opposite to the one direction, and a spacer member retaining portion with a recessed or projected portion for engagement with a projection or a recess formed in the first frame or the second frame to prevent the spacer member from disengaging from the first frame or the second frame in a direction substantially perpendicular to a relative rotational direction between the first frame and the second frame.

It is preferable in the process cartridge that the first regulating portion has a projected portion or recessed portion engageable with a recess or projection formed in the first frame or the second frame, and the second regulating portion has a projected portion or recessed portion engageable with a recess or projection formed in the second frame.

It is preferable in the process cartridge that the spacer member is provided with a grip for being gripped by an operator.

It is preferable in the process cartridge that the grip is in the form of a projection for making the total length of the process cartridge with the spacer member mounted thereto larger than the length of an opening of the main assembly of the image forming apparatus for receiving the process cartridge.

It is preferable in the process cartridge that the developing roller has an elastic material portion which is contactable to the electrophotographic photosensitive drum.

It is preferable in the process cartridge that the developing roller includes a metal core portion made of metal and a surface portion made of elastic material.

It is preferable in the process cartridge that an exposure opening is formed between the first frame and the second frame at an end portion across the coupling member from the electrophotographic photosensitive drum to permit an exposure beam to reach the electrophotographic photosensitive drum.

According to another aspect of the present invention, there is provided a spacer member for a process cartridge. The process cartridge is detachably mountable to a main assembly of an image forming apparatus and includes an electrophotographic photosensitive drum, a developing roller for developing an electrostatic latent image formed on the electrophotographic photosensitive drum with a developer, a first frame supporting the electrophotographic photosensitive drum, a second frame supporting the developing roller, a coupling member for coupling the first frame and the second frame such that the developing roller and the electrophotographic photosensitive drum are contacted to each other or are spaced from each other, an urging member for urging the electrophotographic photosensitive drum and the developing roller toward each other, a spacer member for maintaining a state in which the electrophotographic photosensitive drum and the developing roller are spaced from each other or in which the distance between centers of the electrophotographic photosensitive drum and the developing roller is larger than the distance therebetween during the image forming operation.

The spacer member supports the first frame and the second frame at least at longitudinally extending surfaces of the process cartridge, and is detachable from the process cartridge.

It is preferable in the spacer member that the spacer member applies forces to the first frame and the second frame toward each other at positions across a coupling member coupling the first frame and the second frame with each other from the developing roller.

It is preferable in the spacer member that the first frame and the second frame are coupled by a coupling member for rotation relative to each other about the pin. The spacer member has a first limiting portion for limiting a rotation in one direction and a second limiting portion for limiting a rotation in a direction opposite to the one direction.

It is preferable in the spacer member that the first frame and the second frame are coupled by a pin for rotation relative to each other about the pin. The spacer member has a first limiting portion for limiting a rotation in one direction, a second limiting portion for limiting a rotation in a direction opposite to the one direction, and a spacer member retaining portion with a recessed or projected portion for engagement with a projection or a recess formed in the first frame or the second frame to prevent the spacer member from disengaging from the first frame or the second frame in a direction substantially perpendicular to a relative rotational direction between the first frame and the second frame.

It is preferable in the spacer member that the spacer member is provided with a grip for being gripped by an operator.

It is preferable in the spacer member that the grip is in the form of a projection for making the total length of the process cartridge with the spacer member mounted thereto larger than the length of an opening of the main assembly of the image forming apparatus for receiving the process cartridge.

It is preferable in the spacer member that the projection is capable of being gripped by an operator mounting the spacer member to the process cartridge or dismounting the spacer member from the process cartridge.

According to the above described embodiments of the present invention, a process cartridge can be shipped while keeping the development roller and the electrophotographic photoconductive drum in the process cartridge separated from each other, or keeping the distance between the axial lines of the development roller and the photoconductive drum, greater during shipping than for image formation, making it possible to prevent the development roller from deforming, that is, conforming to the contour of the peripheral surface of the photoconductive drum, eliminating, therefore, the possibility that unsatisfactory development will occur due to the changes which occur to the development nip between the photoconductive drum and development roller, as the deformed portion of the development roller is moved by the rotation of the development roller to the position (nip) where the development roller opposes the photoconductive drum.

As described above, according to the present invention, it is possible to keep the electrophotographic photoconductive drum and the development roller in a process cartridge separated a predetermined distance from each other.

While the invention has been described with reference to the structures disclosed herein, it is not confined to the details set forth, and this application is intended to cover such modifications or changes as may come within the purposes of the improvements or the scope of the following claims.

What is claimed is:

1. A process cartridge detachably mountable to a main assembly of an electrophotographic image forming apparatus for performing an image forming operation when the process cartridge is mounted to the main assembly thereof, comprising:

an electrophotographic photosensitive drum;

a developing roller configured and positioned to develop an electrostatic latent image formed on said electrophotographic photosensitive drum with a developer;

a first frame supporting said electrophotographic photosensitive drum;

a second frame supporting said developing roller, a coupling member configured and positioned to couple said first frame and said second frame such that said developing roller and said electrophotographic photosensitive drum contact each other;

an urging member configured and positioned to urge said electrophotographic photosensitive drum and said developing roller toward each other; and a spacer member configured and positioned to maintain a state in which said electrophotographic photosensitive drum and said developing roller are spaced from each other, wherein said spacer member is mounted on said first frame and second frame at least at one longitudinally extending side of said process cartridge, and is detachable from said process cartridge.

2. A process cartridge according to claim 1, wherein said coupling member comprises a pin and wherein said spacer member applies forces to said first frame and said second frame to bias said first and second frames toward each other, and wherein said spacer member is mounted on said first frame and said second frame at a position opposite from said developing roller with respect to said pin.

3. A process cartridge according to claim 2, wherein said first frame comprises a projection or a recess, and wherein said spacer member comprises:

a first limiting portion configured and positioned to limit a rotation of said first and second frames relative to each other in one direction;

a second limiting portion configured and positioned to limit a rotation of said first and second frames relative to each other in a direction opposite to said one and a spacer-member retaining portion having a recessed or projected portion for engagement with the projection or the recess formed in said first frame, said spacer-member retaining portion being configured and positioned to prevent said spacer member from disengaging from said first frame in a direction substantially perpendicular to a relative rotational direction between said first frame and said second frame.

4. A process cartridge according to claim 3, wherein said first frame comprises a second recess or a second projection or said second frame comprises a recess or projection, wherein said first limiting portion comprises a projected portion or recessed portion engageable with the second recess or the second projection formed in said first frame or the recess or projection formed in said second frame.

5. A process cartridge according to claim 1, wherein said coupling member comprises a pin around which said first frame and said second frame rotate relative to each other, and wherein said spacer member has a first limiting portion configured and positioned to limit a rotation of said first and second frames relative to each other in one direction and a second limiting portion configured and positioned to limit a rotation of said first and second frames relative to each other in a direction opposite to said one direction.

6. A process cartridge according to any one of claims 1–5, wherein said spacer member comprises a grip configured and positioned to facilitate gripping by an operator.

7. A process cartridge according to claim 6, wherein said grip is in the form of a projection, wherein said projection is configured and sized to make the total length of said process cartridge with said spacer member mounted thereto larger than the length of an opening of the main assembly of the image forming apparatus for receiving said process cartridge.

8. A process cartridge according to any one of claims 1–5, wherein said developing roller has an elastic-material portion which is contactable to said electrophotographic photosensitive drum.

9. A process cartridge according to claim 8, wherein said developing roller includes a metal core portion composed of metal and a surface portion composed of elastic material.

10. A process cartridge according to any one of claims 1–5, wherein an exposure opening is formed between said first frame and said second frame at an end portion of said first frame and said second frame on the opposite side of said coupling member from said electrophotographic photosensitive drum, wherein the exposure opening is configured and positioned to permit an exposure beam to reach said electrophotographic photosensitive drum, and wherein said first frame and said second frame are urged by said spacer member in a direction to close said exposure opening.

11. A spacer for a process cartridge, wherein the process cartridge is detachably mountable to a main assembly of an electrophotographic image forming apparatus, wherein the image forming apparatus performs an image forming operation when the process cartridge is mounted to the main assembly thereof, and wherein the process cartridge includes an electrophotographic photosensitive drum, a developing roller configured and positioned to develop an electrostatic latent image formed on the electrophotographic photosensitive drum with a developer, a first frame supporting the electrophotographic photosensitive drum, a second frame supporting the developing roller, a coupling member configured and positioned to couple the first frame and the second frame such that the developing roller and the electrophotographic photosensitive drum contact each other, and an urging member configured and positioned to urge the electrophotographic photosensitive drum and the developing roller toward each other, wherein said spacer comprises:

a spacer member configured and positioned to maintain a state in which the electrophotographic photosensitive drum and the developing roller are spaced from each other, wherein said spacer member is mounted on the first frame and the second frame at least at one longitudinally extending side of the process cartridge, and is detachable from the process cartridge.

12. A spacer according to claim 11, wherein the coupling member comprises a pin, wherein said spacer member applies forces to the first frame and the second frame to bias the first and second frames toward each other, wherein said spacer member is mounted on the first frame and the second frame at a position opposite from the developing roller with respect to the pin.

13. A spacer according to claim 12, wherein the first frame comprises a recess or a projection, wherein the first and second frames rotate about the pin relative to each other, and wherein said spacer member comprises:

a first limiting portion configured and positioned to limit a rotation of the first each other about the pin in one direction;

a second limiting portion configured and positioned to limit a rotation of the first and second frames relative to each other about the pin in a direction opposite to the one direction; and a spacer-member retaining portion having a recessed or projected portion for engagement with the projection or the recess formed in the first frame, wherein said spacer-member retaining portion is configured and positioned to prevent said spacer member from disengaging from the first frame in a direction substantially perpendicular to a relative rotational direction between the first and the second frame.

14. A spacer member according to claim 11, wherein the first frame comprises a recess or a projection, wherein the coupling member comprises a pin around which the first and second frames rotate relative to each other, and wherein said spacer member comprises:

a first limiting portion configured and positioned to limit a rotation of the first and second frames relative to each other about the pin in one direction;

a second limiting portion configured and positioned to limit a rotation of the first and second frames relative to each other about the pin in a direction opposite to the one direction; and a spacer-member retaining portion having a recessed or projected portion for engagement with the projection or the recess formed in the first frame, wherein said spacer-member retaining portion is configured and positioned to prevent said spacer member from disengaging from the first frame in a direction substantially perpendicular to a relative rotational direction between the first frame and the second frame.

15. A spacer according to claim 11 or 12, wherein said spacer member comprises a grip configured and positioned to facilitate being gripped by an operator.

16. A spacer according to claim 15, wherein said grip is in the form of a projection configured and sized to make the total length of the process cartridge with said spacer mounted thereto larger than the length of an opening of the main assembly of the image forming apparatus for receiving the process cartridge.

17. A spacer according to claim 16, wherein said projection is configured and positioned to facilitate being gripped by an operator mounting said spacer to the process cartridge or dismounting said spacer from the process cartridge.

18. An electrophotographic image forming apparatus for forming an image on a recording material when a detachable process cartridge is mounted to a main assembly thereof, said apparatus comprising:

(i) a process cartridge mounted to a mounting portion configured and positioned to detachably mount said process cartridge, said process cartridge including:

an electrophotographic photosensitive drum;

a developing roller configured and positioned to develop an electrostatic latent image formed on said electrophotographic photosensitive drum with a developer;

a first frame supporting said electrophotographic photosensitive drum;

a second frame supporting said developing roller;

a coupling member configured and positioned to couple said first frame and said second frame such that said developing roller and said electrophotographic photosensitive drum contact each other or are spaced from each other;

an urging member configured and positioned to urge said electrophotographic photosensitive drum and said developing roller toward each other;

a spacer member configured and positioned to maintain a state in which said electrophotographic photosensitive drum and said developing roller are spaced from each other; and wherein said spacer member is mounted on said first frame and said second frame at least at one longitudinally extending side of said process cartridge, and is detachable from said process cartridge; and (ii) a feeding member configured and positioned to feed the recording material.

19. A process cartridge detachably mountable to a main assembly of an image forming apparatus for performing an image forming operation when said process cartridge is mounted to the main assembly thereof, comprising:

an electrophotographic photosensitive drum;

a developing roller configured and positioned to develop an electrostatic latent image formed on said electrophotographic photosensitive drum with a developer;

a first frame supporting said electrophotographic photosensitive drum;

a second frame supporting said developing roller;

a coupling member configured and positioned to couple said first frame and said second frame such that said developing roller and said electrophotographic photosensitive drum are spaced from each other;

an urging member configured and positioned to urge said electrophotographic photosensitive drum and said developing roller toward each other; and a spacer member configured and positioned to maintain a state in which the distance between centers of said electrophotographic photosensitive drum and said developing roller is larger than the distance therebetween during the image forming operation, wherein said spacer member is mounted on said first frame and second frame at least at one longitudinally extending side of said process cartridge, and is detachable from said process cartridge.

20. A spacer for a process cartridge, wherein the process cartridge is detachably mountable to a main assembly of an image forming apparatus, wherein the image forming apparatus performs an image forming operation when the process cartridge is mounted to the main assembly thereof, and wherein the process cartridge includes an electrophotographic photosensitive drum, a developing roller configured and positioned to develop an electrostatic latent image formed on the electrophotographic photosensitive drum with a developer, a first frame supporting the electrophotograhic photosensitive drum, a second frame supporting the developing roller, a coupling member configured and positioned to couple the first frame and the second frame such that the developing roller and the electrophotographic photosensitive drum are spaced from each other, and an urging member configured and positioned to urge the electrophotographic photosensitive drum and the developing roller toward each other, wherein said spacer comprises:

a spacer member configured and positioned to maintain a state in which the distance between centers of the electrophotographic photosensitive drum and the developing roller is larger than the distance therebetween during the image forming operation.

* * * * *

UNITED STATES PATENT AND TRADEMARK OFFICE

CERTIFICATE OF CORRECTION

PATENT NO. : 6,947,686 B2
DATED : September 20, 2005
INVENTOR(S) : Tachio Kawai et al.

It is certified that error appears in the above-identified patent and that said Letters Patent is hereby corrected as shown below:

Title page,
Item [57], ABSTRACT,
Line 7, "that developing" should read -- that the developing --.

Column 1,
Lines 53 and 54, "substructual" should read -- substructural --.

Column 7,
Line 11, "a" should be deleted.

Column 8,
Line 10, "roller 22 the" should read -- roller 22 and the --.
Line 41, "(a," should read -- (1a, --.

Column 9,
Line 43, "and" should be deleted.

Column 10,
Line 38, "a" (first occurrence) should read -- of --.

Column 11,
Line 15, "arm 101 clockwise" should read -- arm 101 in a clockwise --, and "shaft 10A" should read -- shaft 101A --.

Column 12,
Line 20, "portions 3 ID." should read -- portions 31D. --.
Line 23, "wall 32A4" should read -- wall $32A_4$ --.
Line 39, "hole 31D," should read -- hole $31D_1$ --.

Column 14,
Line 21, "springs 50 the" should read -- springs 50, the --.

Column 15,
Line 13, "virtually-impossible" should read -- virtually impossible --.
Line 20, "a" should be deleted.

Column 16,
Line 24, "projection( )" should read -- projection) --.

Column 18,
Line 6, "limiting for" should read -- limiting portion for --.

UNITED STATES PATENT AND TRADEMARK OFFICE

CERTIFICATE OF CORRECTION

PATENT NO. : 6,947,686 B2
DATED : September 20, 2005
INVENTOR(S) : Tachio Kawai et al.

It is certified that error appears in the above-identified patent and that said Letters Patent is hereby corrected as shown below:

Column 20,
Line 17, "roller," should read -- roller; --.
Line 30, "and second" should read -- and said second --.
Line 50, "one and" should read -- one direction; and --.

Column 21,
Lines 10 and 20, "claims 1-5" should read -- claims 1, 2 and 5 --.
Line 28, "1-5" should read -- 1, 2 and 5 --.

Column 22,
Lines 3-22, should read:

-- A spacer according to claim 11, further comprising:

a first limiting portion configured and positioned to limit a rotation of the first and seconds frames relative to each other about the coupling member in one direction; and a second limiting portion configured and positioned to limit a rotation of said first and second frames relative to each other about the coupling member in a direction opposite to the one direction. --.

Signed and Sealed this

Eighteenth Day of April, 2006

JON W. DUDAS
*Director of the United States Patent and Trademark Office*